US008182116B2

(12) United States Patent
Zhang et al.

(10) Patent No.: US 8,182,116 B2
(45) Date of Patent: May 22, 2012

(54) LIGHTING FIXTURE WITH RECESSED BAFFLE TRIM UNIT

(75) Inventors: Kanghong Zhang, Torrance, CA (US); Dan Dix, Irvine, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 426 days.

(21) Appl. No.: 12/621,450

(22) Filed: Nov. 18, 2009

(65) Prior Publication Data

US 2010/0061108 A1 Mar. 11, 2010

Related U.S. Application Data

(63) Continuation-in-part of application No. 12/249,683, filed on Oct. 10, 2008, now Pat. No. 7,722,227.

(60) Provisional application No. 60/979,068, filed on Oct. 10, 2007.

(51) Int. Cl.
*F21V 29/00* (2006.01)

(52) U.S. Cl. ..... 362/294; 362/249.02; 362/364; 362/365; 362/373

(58) Field of Classification Search ..... 362/147, 362/249.02, 294, 364–366, 373, 800
See application file for complete search history.

(56) References Cited

U.S. PATENT DOCUMENTS

| | | | | |
|---|---|---|---|---|
| 5,951,151 | A | 9/1999 | Doubeck et al. | |
| 6,217,189 | B1 | 4/2001 | Nassim | |
| 6,719,438 | B2 | 4/2004 | Sevack et al. | |
| 7,186,008 | B2 | 3/2007 | Patti | |
| 7,220,029 | B2 | 5/2007 | Bynum et al. | |
| 7,255,461 | B2 | 8/2007 | Yang | |
| 7,959,332 | B2 * | 6/2011 | Tickner et al. | 362/373 |
| 7,993,034 | B2 * | 8/2011 | Wegner | 362/296.05 |
| 2008/0112170 | A1 | 5/2008 | Trott et al. | |

* cited by examiner

*Primary Examiner* — Stephen F Husar
(74) *Attorney, Agent, or Firm* — Paul Y. Feng; The Eclipse Group LLP

(57) ABSTRACT

A recessed lighting fixture providing illumination from a light source including a plurality of light emitting diodes (LEDs) placed within a cavity of a planar surface, such as a ceiling, wall, or shower. The fixture comprises a baffle integrated with a low profile heat sink that is used to draw heat out of the fixture and communicate that heat to a trim ring of the fixture for dissipation of the heat in the room so that higher intensity light sources can be used. Improved grounding of the recessed trim unit to the recessed housing is provided with combination support and grounding springs. One embodiment of the light source is fixed in position while a second embodiment is gimbal mounted for aiming the light produced by the fixture.

20 Claims, 23 Drawing Sheets

FIG. 21
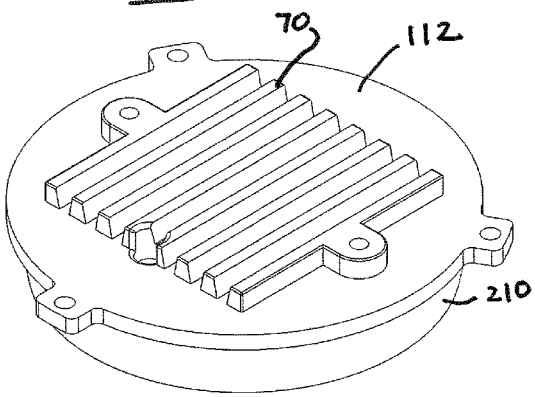
FIG. 22
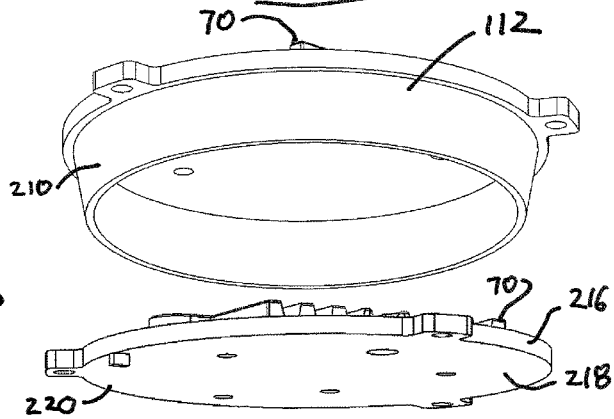
FIG. 23
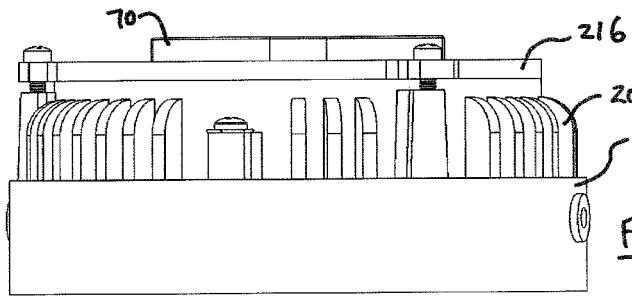
FIG. 24

LIGHTING FIXTURE WITH RECESSED BAFFLE TRIM UNIT

CROSS-REFERENCE TO RELATED APPLICATIONS

This application is a continuation-in-part (CIP) of U.S. application Ser. No. 12/249,683, filed Oct. 10, 2008, now U.S. Pat. No. 7,722,227, which claims priority to U.S. Provisional Application No. 60/979,068, filed Oct. 10, 2007, and to U.S. Application No. 29/295,943 filed Oct. 10, 2007, now U.S. Pat. No. D595,452, all of which are incorporated herein by reference in their entireties.

BACKGROUND

The present invention relates generally to lighting fixtures and, more particularly, to a recessed lighting fixture that provides improved heat dissipation and grounding.

Recessed lighting fixtures are well known in the art. Ideally, such fixtures are designed to be visually unobtrusive in that very little of the lighting fixture is visible from below the ceiling. However, some trim portions are visible as well as the light sources. An opening is cut into the ceiling into which most of the light fixture is mounted so that very little extends below the plane of the ceiling. A trim piece, which may take the form of a bezel, is generally located at the opening to enhance the appearance of the light fixture and conceal the hole cut into the ceiling. Typically, the trim piece is slightly below the planar surface of the ceiling.

Such bezels or other types of trim pieces also include insulation located between the trim piece and the ceiling. In many cases, recessed lighting fixtures are installed in holes in ceilings where the temperature is much different from that of the room into which the light fixture provides illumination. The insulation tends to oppose changes of the room temperature due to the hole cut in the ceiling for the light fixture.

Although described in a ceiling embodiment, such light fixtures are also used in walls in both dwelling structures and in automobiles, in numerous commercial building applications, and in many other applications. For the sake of reference, such lighting fixtures are referred to herein as "recessed."

Different light sources are used for recessed lighting fixtures. Some light sources generate substantial amounts of heat, so much so that the rating of the light fixture must be displayed and warnings given that light sources above a certain wattage could pose an overheating danger and are not to be used. However, in some cases, the light fixture must be located a substantial distance away from the object to be illuminated and higher wattage light sources are necessary to develop the amount of illumination needed. Such wattage limits imposed by the lighting fixtures can undesirably limit the amount of light furnished by the fixture. For example, light fixtures located in higher ceilings, which are more common today, or light fixtures that are meant to shine at an angle other than perpendicular to illuminate an object, may not provide enough light for the object if lower wattage light sources must be used. Consequently, light fixtures able to accommodate higher heat levels are desired in such situations. Such light fixtures must be able to dissipate increased levels of heat to avoid a hazard.

There are two basic configurations of recessed lighting fixtures. One is known as a fixed position light source and the second is known as a movable or gimbaled light source. The first does not permit the light source to be aimed differently than when it was mounted while the second permits relatively easy movement of the light fixture for changing the aim of the light. In the second configuration, movement of the light source to change its aim without disassembly of the fixture is provided. Both types are useful for many applications and in both, the dissipation of heat is a concern.

Gimbaled lighting fixtures were created in which the light can be easily aimed. As is commonly used, a gimbaled mounting provides two mutually perpendicular and intersecting axes of rotation thus giving free angular movement in two directions. In the case of a recessed light source, a gimbaled mounting would provide for tilting the light source to achieve elevational control of its aim, and swiveling, or rotating, the light source to achieve azimuth control. This aiming procedure would typically be performed by a person who must touch the light source while it is in the "on" configuration; i.e., while power is being applied to the light source, so that the direction of light can be seen during adjustment. Touching the light source for aiming or other purposes while "on" exposes the person to any electrical potential or charge residing at the light source. Even if not aiming the light source, touching it for the purpose of repair or replacement can subject the person to any electrical potential residing on the light source. Dissipating heat and any electrical potential are two needs that have been identified for recessed lighting fixtures.

As a brief overview of a recessed light source fixture, a recessed "can" or housing is fixedly mounted into the ceiling through the opening. Such housings are generally metallic and electrically conductive. They also are generally connected to earth ground. A "trim unit," which may include one or more light sources, a trim ring, and other devices to provide the aesthetic design and lighting functions is mounted within the housing. Various trim units may be available for mounting within any one housing. The trim unit typically receives the light bulb or other light source or sources and provides the necessary electrical power to them for illumination.

Various structures have been devised for holding a trim unit in a can. One desired structure is the use of devices that interlock or mate with other devices to positively hold the trim unit in place in the can. Other approaches involving only friction to maintain the trim unit in place are less desirable. It would also be desirable for such mounting devices to form an electrical pathway to the can so that any electrical charge that may build up on the trim unit can be dissipated.

Hence, those skilled in the art have recognized the need for a light fixture in which brighter light sources can be used and any commensurate higher levels of heat can be dissipated. Those skilled in the art have also recognized a need for providing improved means for dissipation of heat from light sources and electrical supply devices used in recessed light fixtures, and for providing the dissipation of any electrical energy that may be developed at the light fixture, in particular at the part of the fixture more likely to be touched by a person attempting to repair or aim the light source. A need has also been recognized for a positive mounting arrangement of the trim unit in the recessed housing so that the trim unit is held in the housing through an interference or interlocking mounting system sufficient to prevent the trim unit from falling out of the recessed housing. The present invention fulfills these needs and others.

SUMMARY OF THE INVENTION

Briefly and in general terms, the present invention is directed to a recessed lighting fixture that allows aesthetically pleasing illumination when the fixture is placed within a cavity of a planar surface, such as a ceiling, wall, or shower. A low profile heat sink is integrated with a baffle to result in improved heat control. An improved grounding of the trim unit to the recessed housing is also provided.

In accordance with aspects of the invention, there is provided a recessed lighting fixture located in an opening of a surface, the surface having an outer side and an inner side, the lighting fixture comprising a recessed housing located in a recessed configuration in the opening of the surface adjacent the inner side, a lighting trim unit comprising a trim ring configured to be disposed at the opening of the outer side of the surface, a light source that emits light, the light source located within the recessed housing and disposed so as to emit light at the opening, a baffle surrounding the light source and in contact with the trim ring to direct light from the light source at the opening, the baffle having a first end located adjacent the opening in the surface and a second end located within the recessed housing opposite the first end, and a low profile heat sink integrated with the baffle, wherein the integrated baffle heat sink draws heat out of the recessed housing and conducts it to the trim ring, whereby heat communicated to the trim ring may be dissipated at the outer side of the surface.

In accordance with more detailed aspects, the integrated baffle heat sink surrounds the light source. The integrated baffle heat sink is in contact with the light source to draw heat from the light source. The trim ring and the baffle are formed together as a single part. In another aspect, the trim ring, the baffle, and the integrated baffle heat sink are formed together as a single part.

Further more detailed aspects include the baffle being formed into the baffle heat sink having a plurality of heat sink fins protruding outwardly. In another aspect, the baffle heat sink fins protrude radially outwardly and are oriented in parallel with a longitudinal axis of the baffle. The sizes and number of baffle heat sink fins are selected to result in the integrated baffle/heat sink being low profile.

In yet more detailed aspects, the recessed lighting fixture further comprises a second heat sink located at the second end of the baffle to which the light source is mounted, the second heat sink configured to draw heat from the light source, the second heat sink connected to the baffle. The second heat sink comprises a plurality of heat sink fins protruding outwardly. The recessed lighting fixture further comprises a driver configured to provide power to the light source with the second heat sink being mounted to the driver and to the light source, the second heat sink configured to draw heat from the light source and driver, the second heat sink connected to the baffle.

In other aspects, the recessed lighting fixture comprises a light source that is fixed in position in relation to the trim ring and integrated baffle/heat sink so that light provided by the light source cannot be selectively aimed. In another aspect, the light source is movable in position in relation to at least one of the trim ring, the housing, and the integrated baffle/heat sink so that light provided by the light source can be selectively aimed. The movable light source is gimbal mounted.

Other aspects include the trim unit further comprising an electrically conductive spring in electrical contact with the trim unit, the spring having two elongated legs for contact with the recessed housing, each leg having a bent portion at an end that is shaped so as to engage a portion of the recessed housing in an interference fit to thereby hold the trim unit in place in relation to the recessed housing and provide an electrical pathway between the trim unit and the recessed housing. The recessed housing comprises spring mounting openings for receiving the bent ends of the spring to thereby hold the trim unit in place in the recessed housing. Further, the ends of the springs are spaced from a mounting point of the spring to the trim unit to provide a fail-safe distance of engagement with the recessed housing in the event that the trim unit were to fall slightly from the recessed housing due to shock or vibration.

In other more detailed aspects, a first portion of the trim ring is located on the outer side of the opening and a second portion of the trim ring extends into the opening, and the spring has a central coil which is attached to the second portion of the trim ring to thereby hold the first portion of the trim ring against the opening and hold the remaining portion of the trim unit in the recessed housing when the ends of the springs are engaged with the recessed housing.

Yet other aspects include the trim unit further comprising a tilting mechanism to which the light source is mounted to permit adjustment of elevational aim of the light source without having to remove the trim unit from the recessed housing. The trim unit further comprises a gimbal mounting mechanism disposed so that the light source is gimbal mounted in relation to one or both of the trim ring and the housing.

Other aspects include the light source comprising at least one light emitting diode.

In accordance with still further aspects of the invention, there is provided a recessed lighting fixture located in an opening of a surface, the surface having an outer side and an inner side, the lighting fixture comprising a recessed housing located in a recessed configuration in the opening of the surface adjacent the inner side, a lighting trim unit comprising a trim ring having a first portion located on the outer side of the opening and a second portion of the trim ring extending into the opening, the trim ring formed of an electrically and thermally conductive material, a light source that emits light, the light source located within the recessed housing and disposed so as to emit light at the opening, a baffle having an integrated low profile heat sink formed as a single piece disposed about the light source and connected with the trim ring, the baffle located within the recessed housing, wherein the integrated heat sink comprises a plurality of heat sink elements protruding outwardly, the baffle formed of an electrically and thermally conductive material, and a metallic spring in electrical contact with the baffle, the spring configured to engage the recessed housing to thereby establish an electrical pathway between the baffle and the housing and to hold the trim unit in place in relation to the recessed housing.

In more detailed aspects, the light source comprises a plurality of light emitting diodes. The light source is fixed in position and cannot be moved to change the direction of light emitted, and in another aspect, the light source is configured to be movable so that the direction of light emitted by the light source can be selectively aimed.

These and other aspects, features, and advantages of the present invention will become apparent from the following detailed description of the preferred embodiments which, taken in conjunction with the accompanying drawings, illustrate by way of example the principles of the invention.

BRIEF DESCRIPTION OF THE DRAWINGS

FIG. 21 is a top perspective view of one embodiment of a trim unit top;

FIG. 22 is a bottom perspective view of the trim unit top from FIG. 21;

FIG. 23 is a bottom perspective view of an alternative embodiment of a trim unit top;

FIG. 24 is a side elevational view of a trim unit where the top is assembled to the baffle;

DETAILED DESCRIPTION OF THE PREFERRED EMBODIMENTS

Figure 1:
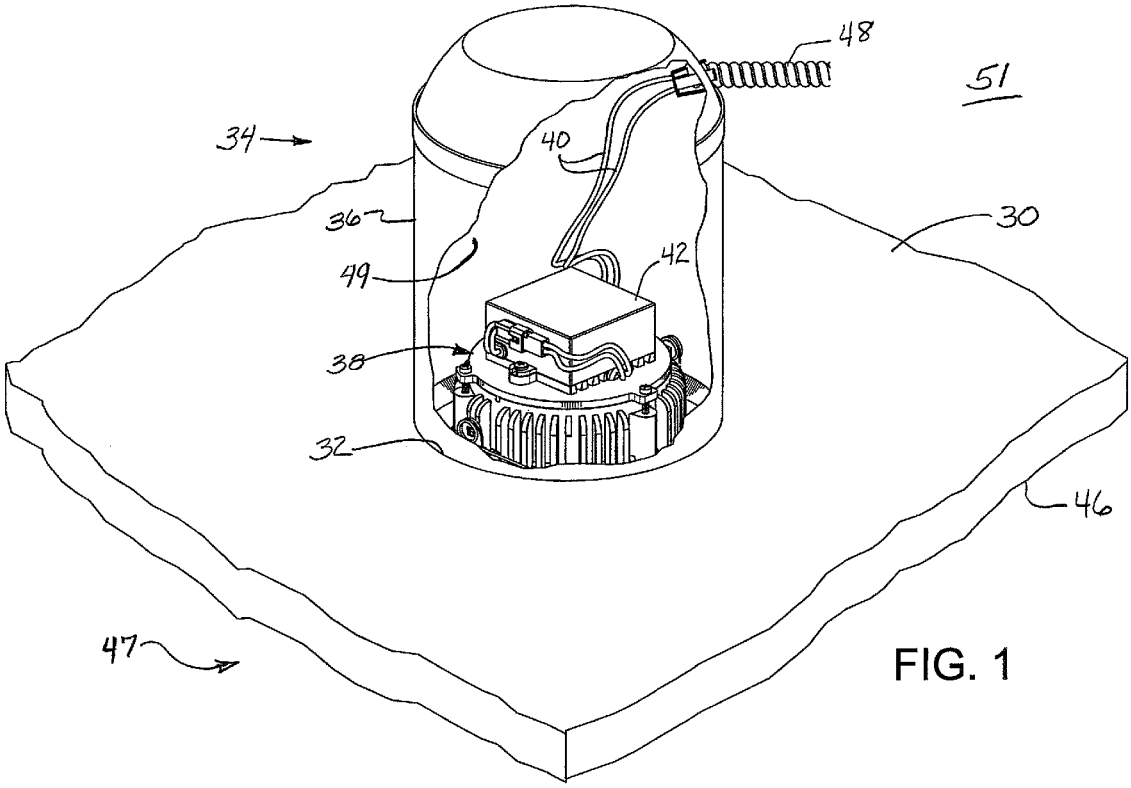
FIG. 1 is a top perspective view of a planar surface having an opening made to receive a recessed light fixture at the inner side of the surface, showing the recessed housing of the fixture and, in partial cutaway, a schematic view of a trim unit mounted within the housing with associated wiring.
Figure 1A:
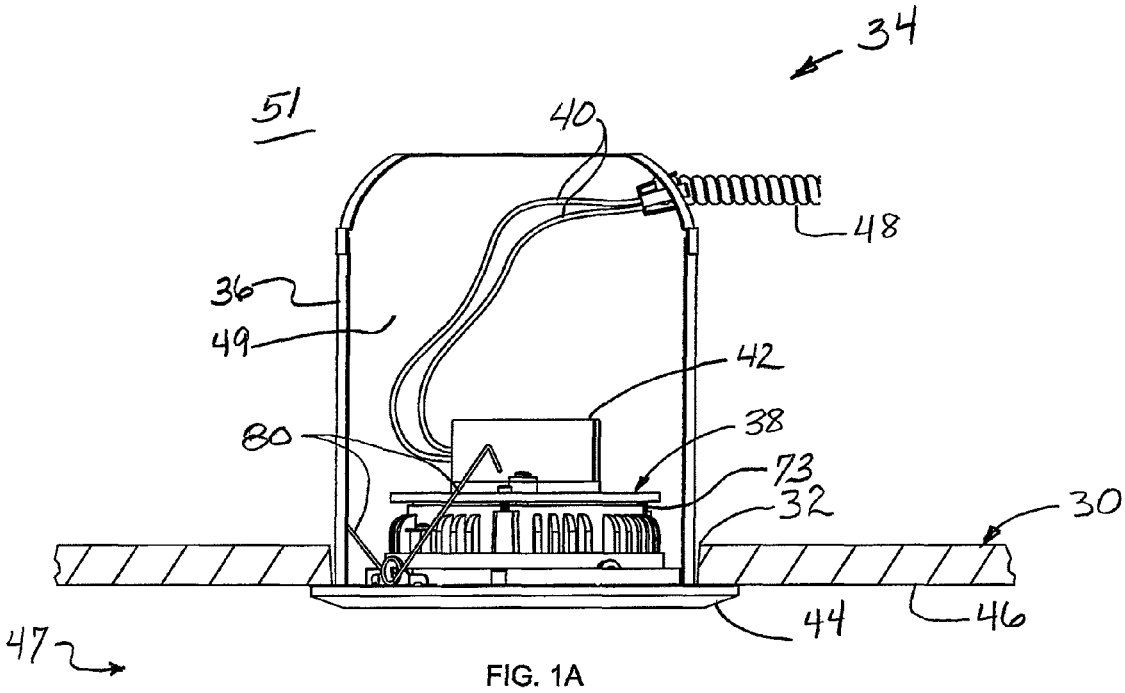
FIG. 1A is a cross-sectional side view diagram showing the recessed housing of FIG. 1 mounted in the opening of the planar surface with the trim ring being located on the outer side of the planar surface through which an opening was made to receive the recessed light fixture, also shown is a coiled torsion spring used to hold the trim unit in the housing.

Referring now to the drawings in more detail in which like reference numerals refer to like or corresponding devices among the views, there is shown in FIGS. 1 and 1A a top perspective view and a side view, respectively, of a planar surface 30 having an opening 32 made to receive a recessed light fixture 34. Both figures show the recessed housing 36 or "can" of the light fixture and in cutaway views, a trim unit 38 mounted within the housing. Power wires 40 provide power to a drive unit 42 that provides power to the light sources (not shown). The trim unit includes a trim ring 44 located on the outer side 46 of the planar surface 30 that is larger than the opening 32 (shown in FIG. 1A). The trim ring 44 covers the opening and provides a stop surface for the trim unit 38 so that it cannot be recessed entirely into the opening. In the case where the planar surface 30 is a ceiling, the trim ring 44 is located within the room 47 of which the ceiling forms a part. As described below in more detail, the trim ring 44 is configured to draw heat away from the trim unit 38 and conduct it to the room 47 for dissipation which will result in cooling of the trim unit 38.

Although shown as free standing in FIG. 1, the recessed housing 36 may also be braced by connection to studs or other construction features in the ceiling or wall or other structure in which it is located. Details of such common and well known mounting techniques for recessed housings have been excluded for the sake of clarity in the drawings. Various additional mounting techniques are well known to those of skill in the art and no further details are provided herein. The provision of electrical energy in FIG. 1 is shown as two wires from a conduit 48; however, as will be shown in other figures, electricity may be provided by other means, such as a light socket adapter.

The light source, such as light emitting diodes ("LEDs"), and/or the driver 42 that provides the necessary electrical energy to cause the LEDs to emit light typically create heat. Because they are located within the housing 36, the internal space 49 in the housing will typically increase in temperature. In accordance with an aspect of the invention, the trim unit 38 is configured to conduct heat from the heat-producing elements to the trim ring 44 that is located within a much larger space; i.e., the room 47. It can be seen in FIG. 1A that the trim ring 44 located within the room 47 is in contact with the other components of the trim unit 38 located within the recessed housing 36. Those other components of the trim unit are also in contact with heat that may exist in the internal space 49 of the housing 36, and are therefore equally capable of also conducting that heat to the trim ring for dissipation within the room. In this way, heat developed within the housing can be better controlled. This enables the use of higher wattage light sources in the trim unit.

Also shown partially in FIG. 1A is the use of springs 80 to hold the trim unit 38 within the recessed housing 36. Although not shown clearly, the torsion springs 80 are fit into openings in the housing in an interlocking manner resulting in the force of the springs pulling and holding the trim unit up in the housing with the trim ring 44 held against the outer side 46 of the surface 30. Although not shown, insulation may be positioned between the trim ring 44 and the opening 32 of the outer side 46 of the surface 30 to prevent the temperature of the air in the area 51 surrounding the recessed housing 36 from affecting the temperature in the room 47.

Accordingly, the present invention recessed LED light fixture can be easily adapted to retrofit existing canned housing found throughout residential homes and commercial buildings, which canned housing were intended for use with incandescent or halogen bulbs. The size of the trim unit and torsion spring mounting hardware are designed with this retrofit in mind to fit within industry standard cans that are themselves sized to fit within the typical 24 inches of space between ceiling joists in residential construction. An optional light socket adapter 60 is provided for conducting power to the LEDs and is designed to fit into a standard 120V AC light socket found in existing recessed lighting cans. Therefore, recessed light fixtures that were designed for incandescent or halogen light bulbs can be easily converted by using the present invention to use more electrically efficient, and longer lasting LEDs.

Figure 2:
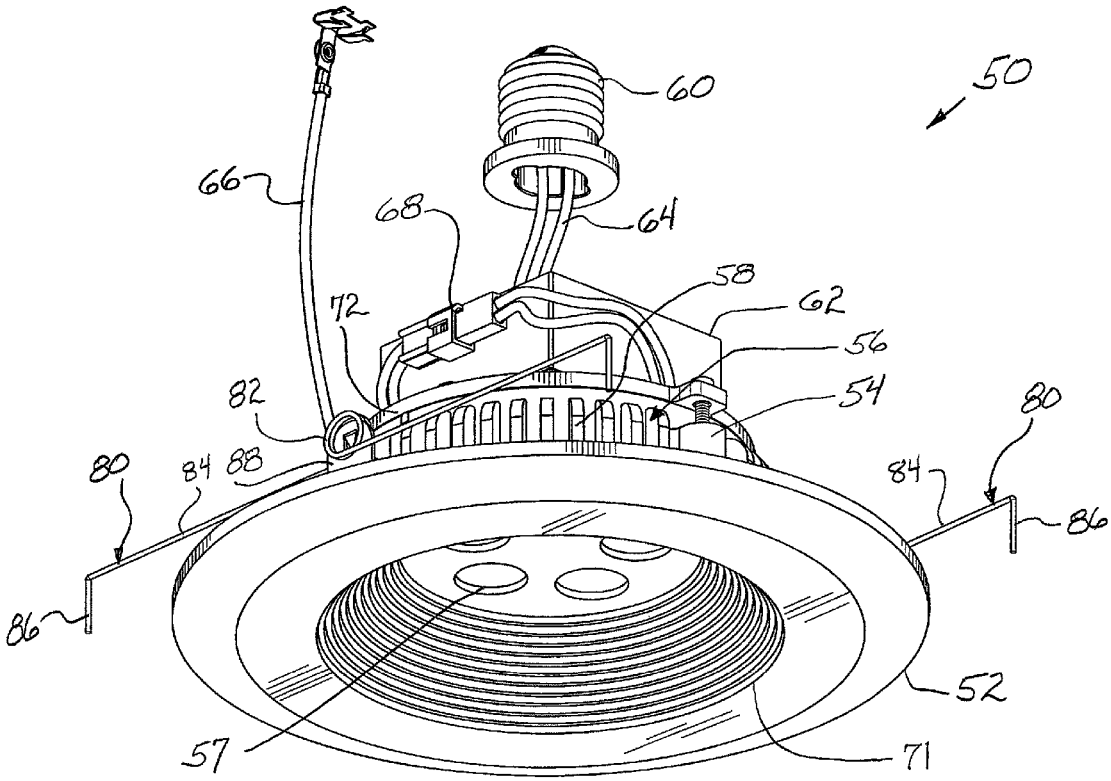
FIG. 2 is a bottom perspective view of a trim unit in accordance with aspects of the invention having a fixed position light source, showing the frusto-conically-shaped baffle with integrated heat sink, a plurality of LED lights forming a light source, a driver to provide appropriate power to the LED lights, a grounding strap connected to the trim unit for attachment to the housing, a light socket adapter, and electrically conductive mounting springs usable to provide an electrical pathway between the trim unit and the housing.
Figure 3:
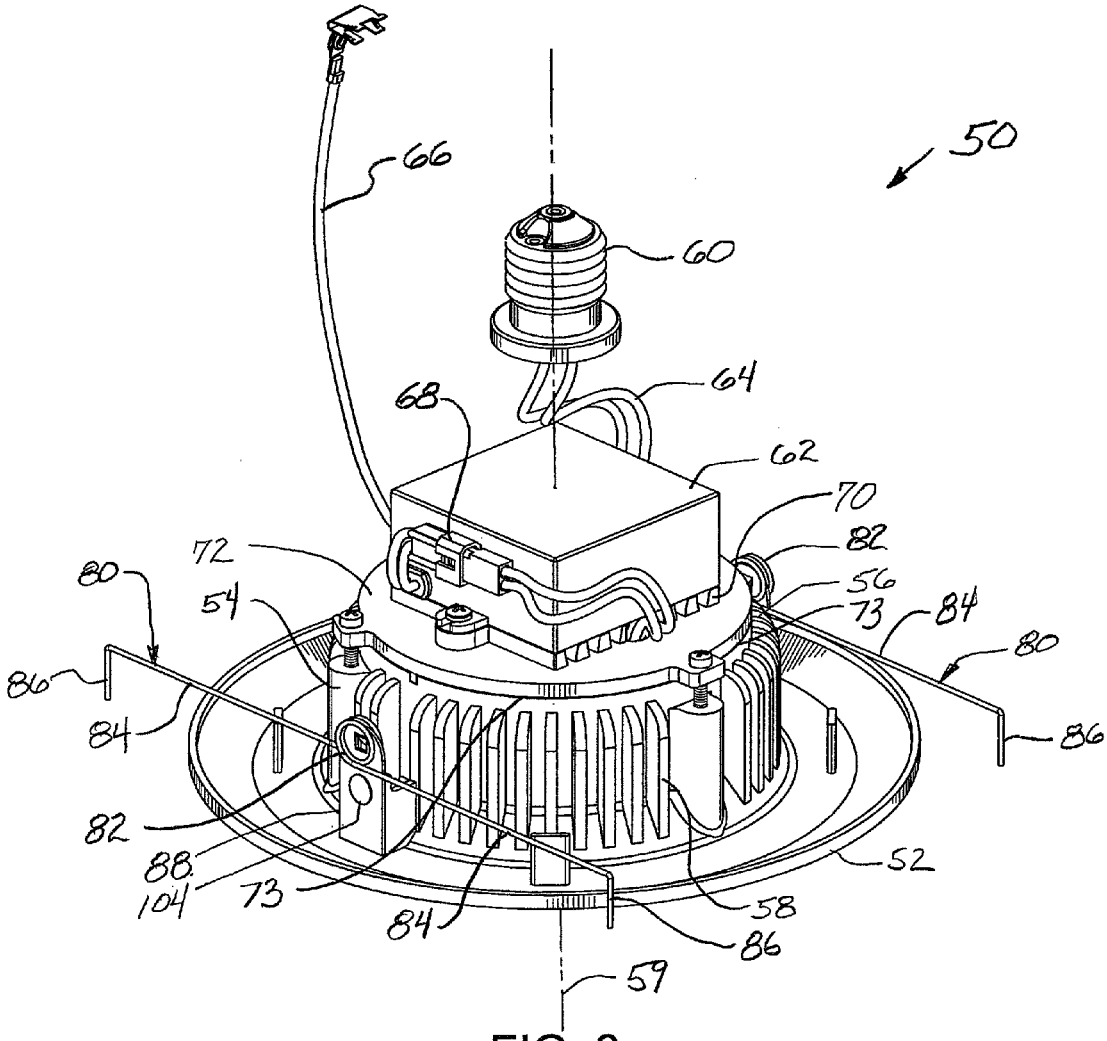
FIG. 3 is a top perspective view of the trim unit shown in FIG. 2 showing more detail of the heat sink integrated with the baffle which are also made formed with the trim ring as a single piece, the electrically conductive mounting springs, the driver, and a second heat sink disposed between the driver and the LED lights to further draw heat away from the light fixture, the view also showing how the integrated baffle/heat sink and trim ring formed as a single piece will assist in drawing heat away from the light source to dissipate the heat on the outer side of the planar surface in which the recessed fixture is mounted.

Referring now to FIGS. 2 and 3, bottom and top perspective views are provided of a first trim unit 50. This particular trim unit is a fixed position trim unit, meaning that once mounted, the aim of the light source within it cannot be changed. This is in contrast to a gimbaled light source in which the light source aim can be relatively easily moved, as is discussed in more detail below. The trim unit of FIGS. 2 and 3 comprises a trim ring 52, similar to that shown in FIGS. 1 and 1A, which is part of a baffle 54. In this case, the baffle 54 and trim ring 52 are a single piece; however, in other embodiments, they may be separate pieces, as discussed and shown below. In accordance with an aspect of the invention, the baffle 54 is integrated with a low profile heat sink 56 used to draw heat from the light sources 57 mounted within the baffle. The heat drawn from the light sources may be transferred from the trim unit 50 by thermal transfer, such as convection, conduction, and/or radiation. The integrated baffle/low profile heat sink includes, in this embodiment, a plurality of heat sink fins 58. Although the drawing numeral 58 is only pointing to a single fin, it is meant to include all fins in the figures. A single fin is indicated with the reference numeral to maintain the clarity of the drawing. The same reason applies for the reference numeral 57 to indicate a light source. In FIGS. 2 and 3, and in other figures, a plurality of light emitting diodes (LEDs) 57 are used for the light source. For the sake of clarity of the drawings, the numeral 57 is only pointing to one, although it is meant to include all.

In this embodiment, the heat sink fins have a rectangular cross-sectional shape, although other shapes can be used. Also, the heat sink fins are oriented radially about the longitudinal axis 59 of the integrated baffle/heat sink 54/56 and extend in parallel with that longitudinal axis. The heat sink fins 58 provide a much larger surface area for the dissipation of heat conducted to the fins from the enclosed light sources.

FIGS. 2 and 3 also show the use of a light socket adapter 60 to provide power for light source operation, although other means may also be used. In this embodiment, a driver unit 62 is wired 64 to the adapter and processes the received electrical energy for use by the light sources 57. A ground strap 66 is also provided in this embodiment to provide an electrical connection between the driver unit 62 and the housing 36 (FIG. 1), which is typically grounded to earth ground. A connector 68 is provided for easy connection and disconnection of the drive unit to the light source 57. Additionally, a second heat sink 70 (FIG. 3) is provided to draw heat away from the drive unit and heat from the light source that exits at the trim cup 72 located at the second end 73 of the baffle. In this embodiment, the trim ring 52 and integrated baffle and heat sink 54 are formed as a single piece of cast aluminum. The trim cup 72 and second heat sink 70 are also formed as a single piece of cast aluminum in this embodiment Also forming a part of the trim unit 50 is a pair of torsion springs 80. Each spring includes a central coil 82, two elongated legs 84 and a bent end 86. In this case, the end is bent at a right angle to engage receiving slots formed into or mounted to the recessed housing, which will be shown in a later figure. The torsion springs are electrically conductive and are attached to respective spring brackets 88 to form both a mechanical bond and an electrical pathway to the baffle 54. The brackets are electrically conductive and are riveted to the baffle thus providing electrical communication between the baffle and the springs. The length of the elongated legs of the springs is selected so that the springs hold the trim ring firmly against the outer side 46 of the planar surface 30 in which the recessed fixture 34 is installed so that shock or vibration will not cause the fixture to fall out of the recess or opening 32. At the same time, the length is selected so that the trim unit 38 can be pulled downward from the recess housing far enough to disengage the bent ends 86 from the slots in the housing for removal of the trim unit.

To briefly reiterate, in the embodiment represented by FIGS. 2 and 3, the baffle/integrated heat sink, and trim ring, all of which are formed as a single piece, are formed of an electrically conductive and thermally conductive metal, the torsion spring mounting bracket and rivet are also formed of electrically conductive and thermally conductive metal as are the torsion springs themselves. This arrangement of electrically conductive materials provides an electrical pathway for any charge that may tend to build up on the trim ring, baffle, or other parts to be dissipated by the connection of the torsion springs to the recess housing 34. Although FIGS. 2 and 3 show a stand-alone ground strap 66, not every recess housing may provide such a ground wire. Therefore, the trim unit in accordance with this aspect of the invention makes such a grounding pathway available in any case.

Figure 4:
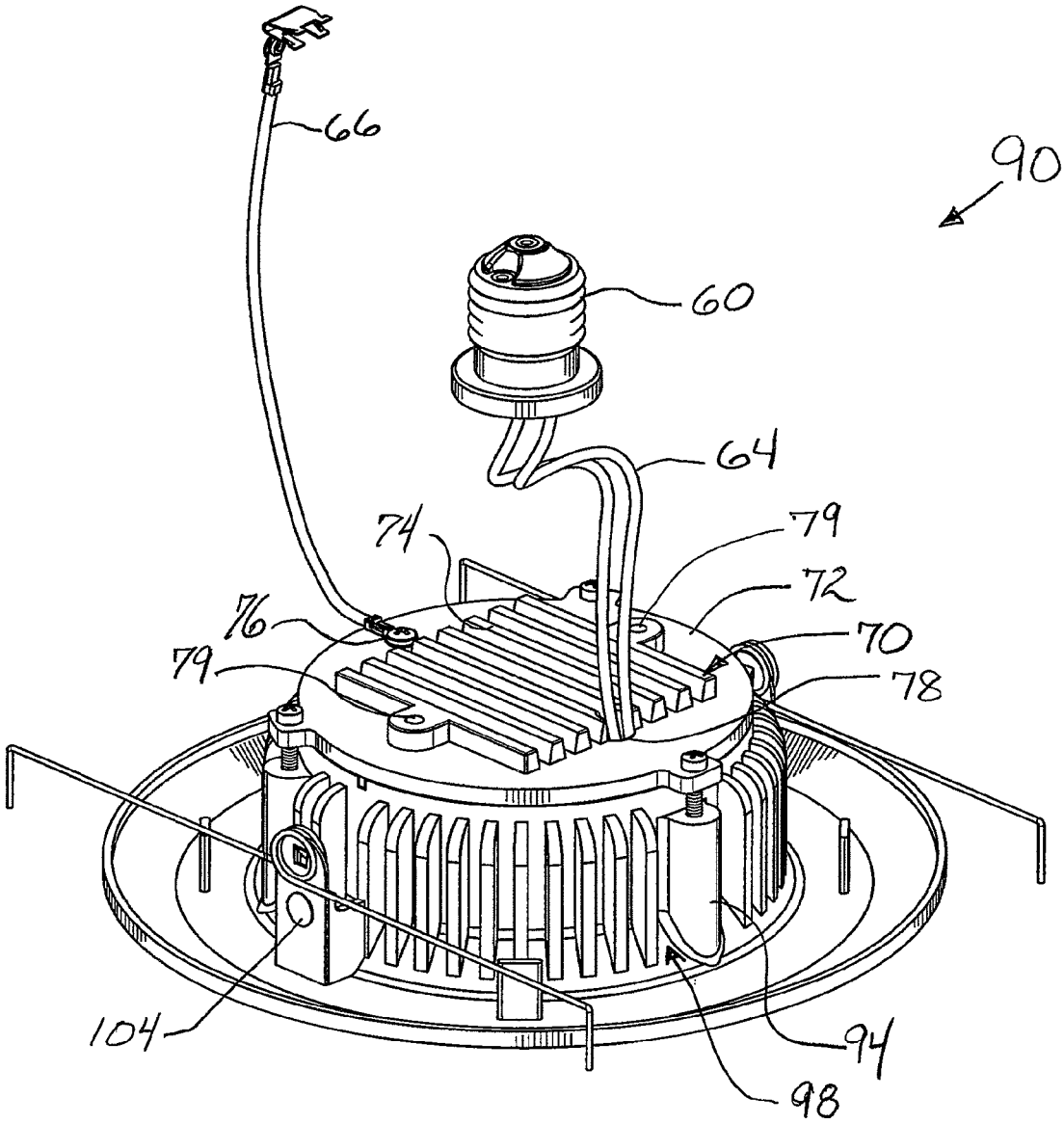
FIG. 4 is a further embodiment of a trim unit having a fixed position light source similar to FIGS. 2 and 3 in which the trim ring and baffle with integrated heat sink are formed as a single piece for conducting heat out through the trim ring, also demonstrating the optional use of a driver in that the light emitting diodes of this embodiment do not require a driver, hence none has been installed at the trim unit resulting in the figure more clearly showing the second heat sink at the end of the baffle, the second heat sink being formed as a single piece with the end cap of the baffle, the circuit board of the LED lights being attached to the inner surface of the end cap.

FIG. 4 provides a further embodiment of a fixed position trim unit 90 that is similar to that provided in FIGS. 2 and 3. However, FIG. 4 demonstrates the optional use of a driver for the LEDs. In this embodiment, the light emitting diodes do not require a driver, hence non has been installed at the trim unit 90. Power is provided to the LED lights directly from a light socket adapter 60 through the wires 64. Because there is no driver used in this embodiment, the trim cup 72 with integral second heat sink 70 can be more clearly seen. In this embodiment, the trim cup and second heat sink are integrally formed as a single piece of cast aluminum. The second heat sink fins 74 have a trapezoidal cross-section shape in this embodiment, although other shapes may be used. The grounding strap 66 is attached to the trim cup by a screw 76 in this embodiment to establish electric communication with the trim unit 90. As discussed previously, the grounding strap 66 will be attached at a convenient location to the housing 36 (FIG. 1) which is typically connected to an earth ground. The trim cup 72 further includes a wire opening 78 through which the power wires 64 are located to provide power to the array of LEDs 57 within the baffle 94. The trim cup also includes two screw guides 79 at each end of the second heat sink 70 for receiving screws used to mount the driver device to the trim cup (see FIG. 3).

FIG. 4 also shows screw standoffs, one of which is indicated by numeral 94, for securing the trim cup with its attached light source printed circuit board to the baffle 98. The second heat sink 70 remains integrated with the baffle. Otherwise, the configuration remains the same as in FIGS. 2 and 3. An exploded view of the trim unit 90 of FIG. 4 is shown in FIG. 5.

Figure 5:
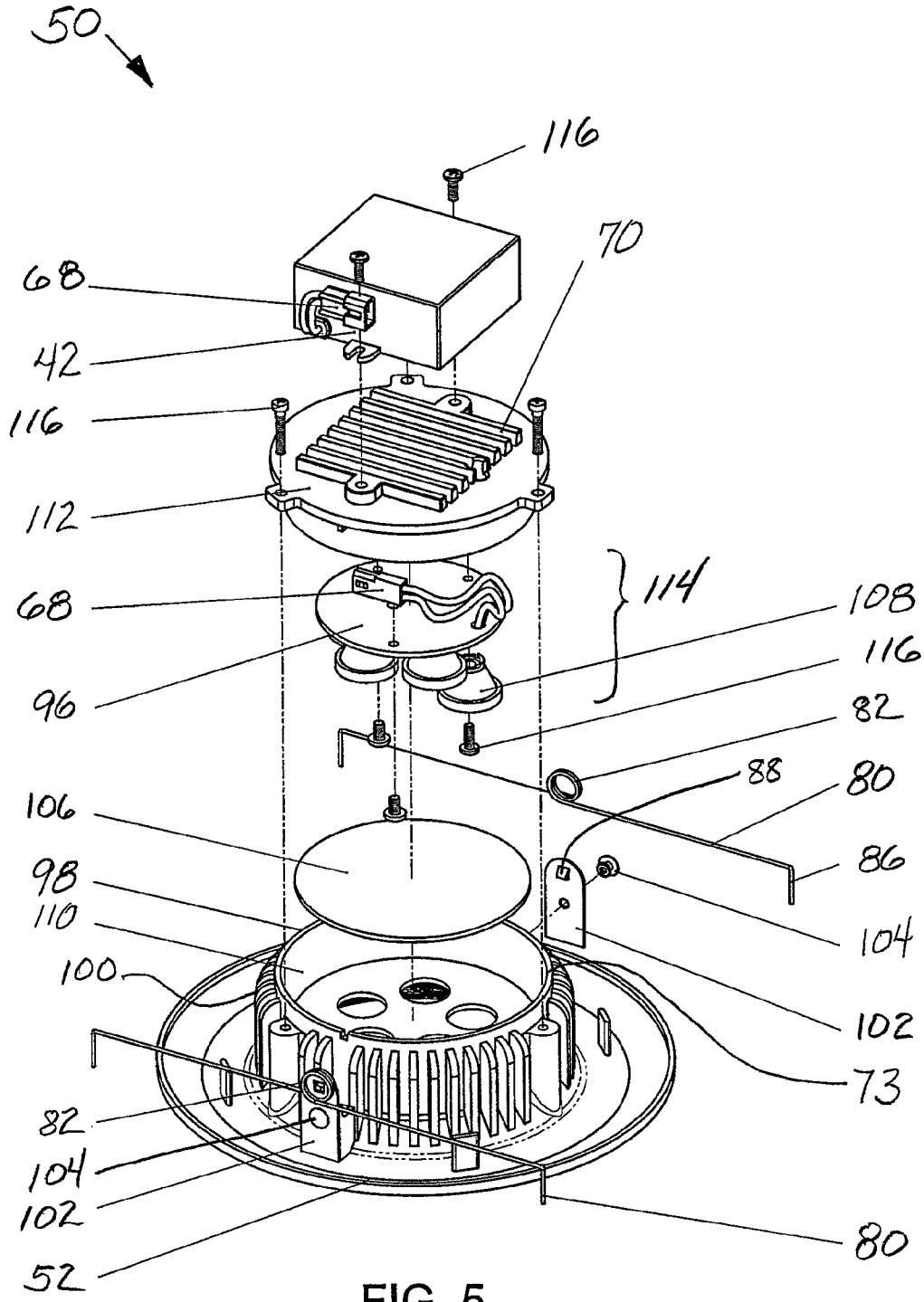
FIG. 5 is an exploded view of the trim unit of FIGS. 2 and 3 showing in some detail the lenses that are positioned over the LED lights, the single piece baffle/heat sink and trim ring combination, the second heat sink formed as part of the trim unit end cap as a single piece, the drive unit, and the electrically conductive mounting springs.

Turning now to FIG. 5 in more detail, the baffle 98 with integrated heat sink 100 which is formed as a single piece with the trim ring 52 is shown with torsion springs 80 and torsion spring brackets 102. Electrically conductive metallic rivets 104 are used to hold the brackets to the baffle 98. A tempered glass plate 106 is disposed in the cavity 110 of the baffle 98 below the LED light sources (not shown) which are located within LED lenses 108. The trim cup 112 and second heat sink 70 are formed as a single piece of electrically and thermally conductive material and serve as a mounting platform for the driver 42, the LED printed circuit board 96 and the LEDs, although they are not shown in this figure. Although LEDs are indicated as the device used to provide light in this embodiment, other devices may be used; the LED is only one example. The light source is indicated by the collective reference numeral 114 in this example. The connector 68 includes both male and female parts. Standard screws 116 are used to complete the embodiment of FIG. 5.

Figure 6:
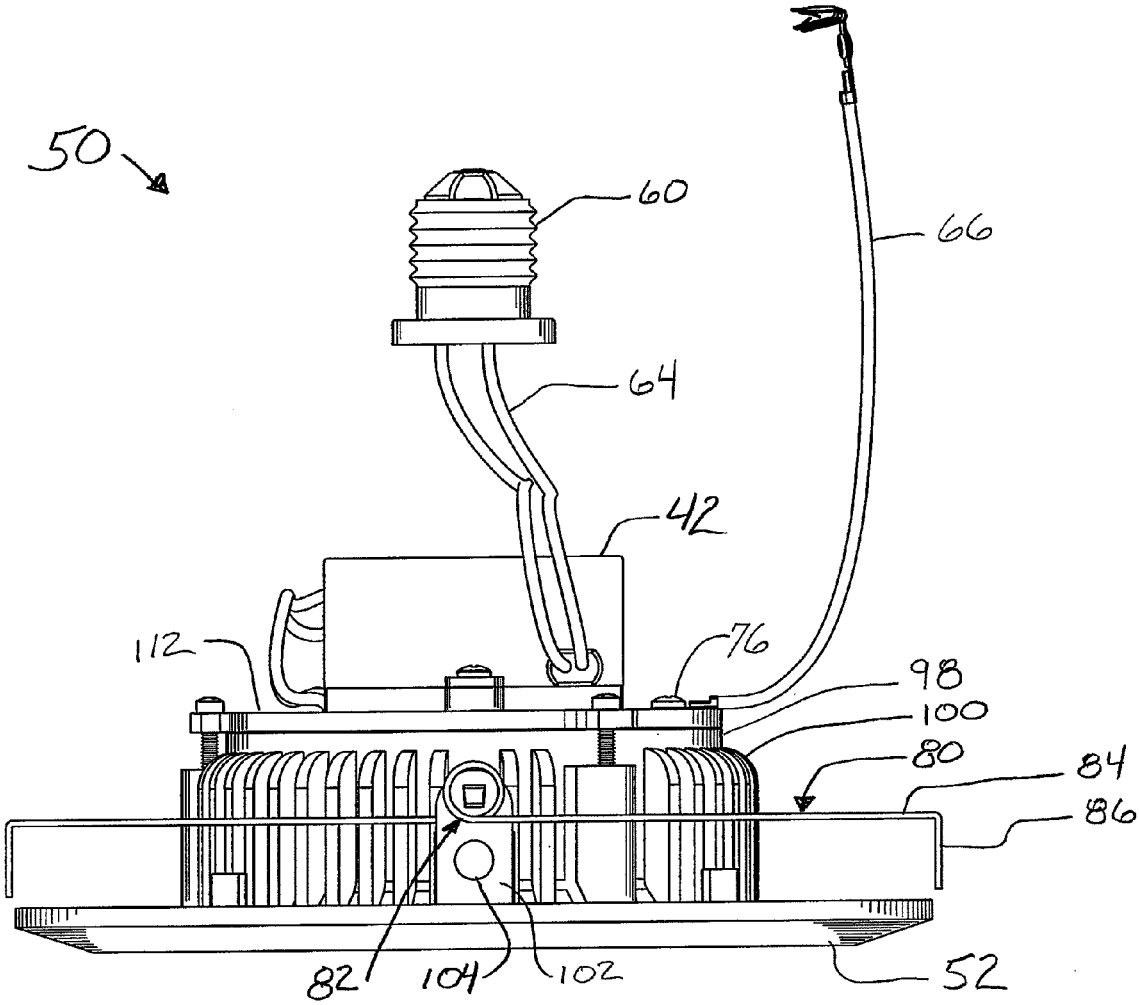
FIG. 6 is a side view of the trim unit of FIGS. 2 and 3 showing a grounding strap for connection to a grounded recessed housing or "can" such as that shown in FIG. 1, and an AC light socket adapter for engaging a mains power connector.
Figure 7:
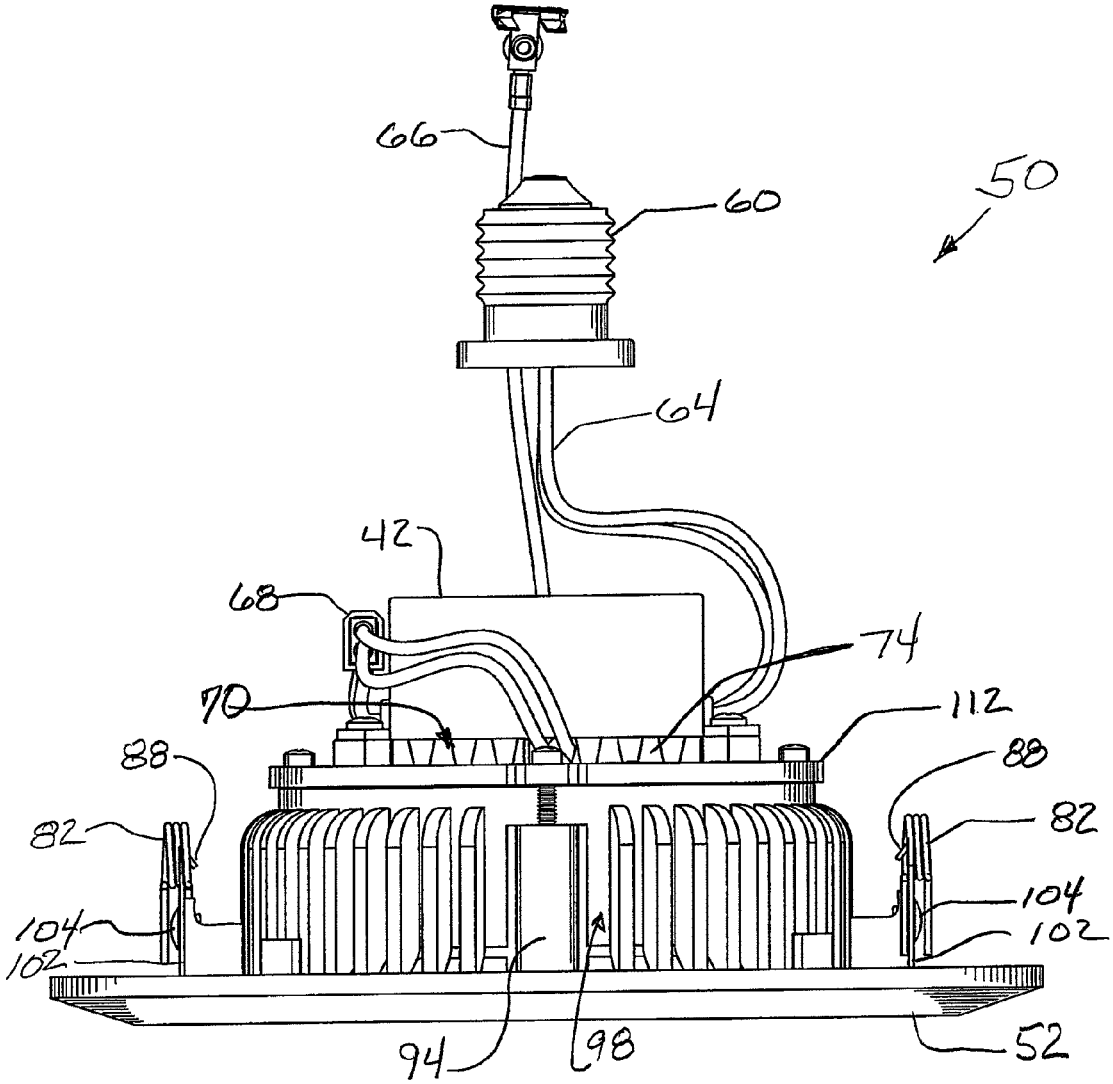
FIG. 7 is a side view of the trim unit of FIGS. 2, 3, and 6 rotated ninety degrees from FIG. 6 showing the attachment of the electrically conductive mounting springs to the trim unit, and also showing the heat radiating fins formed as an integral part of the baffle.
Figure 8:
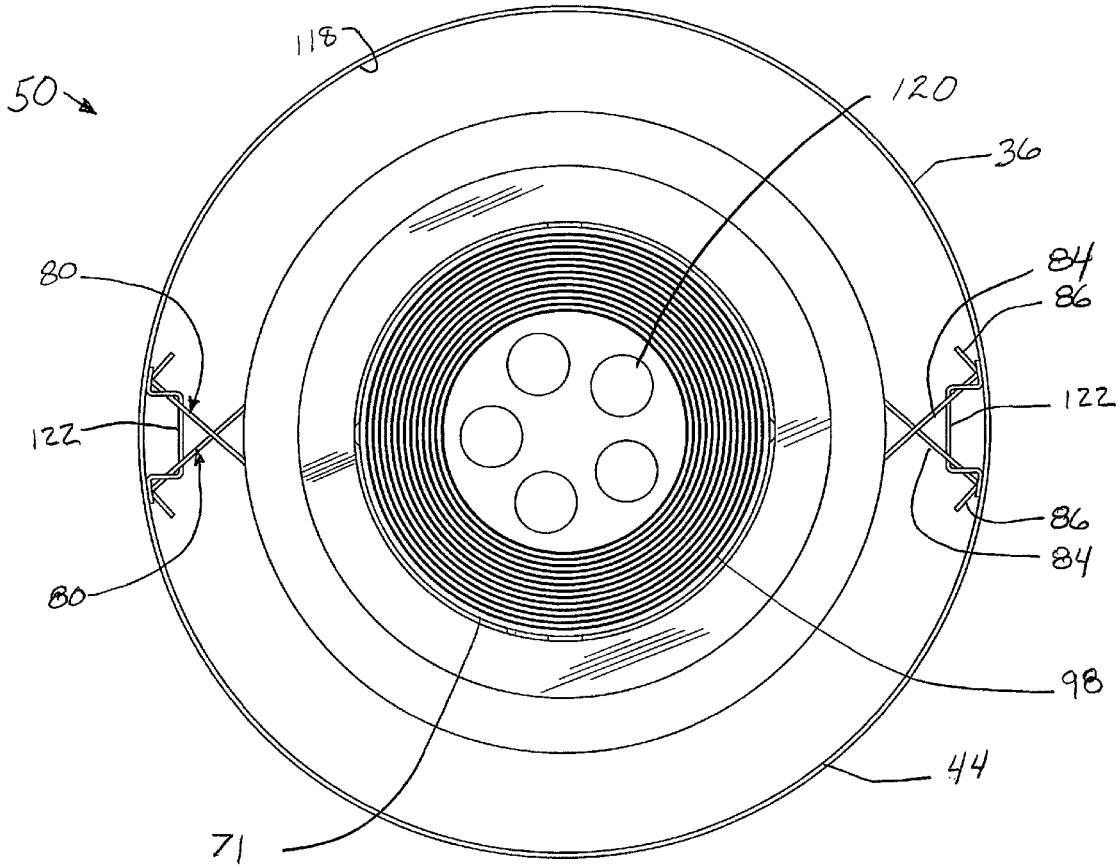
FIG. 8 is a bottom view of the trim unit of FIGS. 6 and 7 mounted in a housing or can showing five LED light sources that are fixed in position, the trim ring that would be located on the outer side of the planar surface within which the recessed light fixture is mounted as shown in FIG. 1, the inner portion of the baffle that is integrated with the heat sink, and the mechanical and electrical interconnection of the trim unit with the recessed housing effected by the physical interference or interlocking fit of the springs with openings or brackets positioned on the internal surface of the recessed housing.

FIGS. 6 and 7 are assembled side views of the fixed position trim unit 50 of FIGS. 2 and 3 rotated from each other by ninety degrees. Each view shows the drive unit 42 attached to the trim cup 112 which in turn, is attached to the baffle 98. Trim cup 112 with integrated second heat sink, baffle, and the integrated baffle heat sink are all formed of cast aluminum in one embodiment. FIG. 7 shows further detail of the second heat sink 70 and heat sink fins 74. Also in FIGS. 3, 4, 5, and 7, the coil 82 of each of the spring members 80 includes three coils wrapped around a bent member 88 of each of the brackets 102. In one embodiment, the bent member is simply a portion of the bracket that has been cut on three sides and forced to bend inward far enough to provide a support for the respective coils 82 of the spring 80 as seen in FIG. 7. As mentioned earlier, the rivets 104 used to hold the brackets 102 to the baffle are electrically conductive thereby establishing an electrical pathway from the trim unit 50 to the springs 80 and to the housing 36, as shown in FIG. 8. Any charge that tends to build up on the trim unit can therefore be dissipated by conducting it through this pathway to the earth-grounded housing 36.

FIG. 8 provides a bottom view of the trim unit 50 clearly showing the trim ring 44 and five LED lights 120 that form a part of the light source 114 (FIG. 5). The figure also shows the interaction of the springs 80 with the recessed housing 36 in that the bent ends 86 of the springs are disposed in spring mounting openings 122 formed as part of the housing. In this case, the spring mounting openings are formed from brackets attached to the inner wall 118 of the housing. Other embodiments are possible, such as where a portion of the housing is cut and bent inward to receive the spring ends. The position of the housing openings 122 for receiving the spring ends and the length of the springs from their mounting points at the trim unit are selected to provide a fail-safe distance 124 (see FIG. 9) of engagement with the recessed housing. This fail-safe distance results in the springs being under sufficient tension to hold the trim unit in place in the housing during periods of shock and vibration experienced by the light fixture 34 that may tend to cause the trim unit to fall slightly from the recessed housing, yet the selected tension nevertheless will permit a person to pull the trim unit down from the recessed housing far enough to disconnect the springs from the housing openings for repair or replacement of the trim unit. An example of the configuration of the springs at a fail-safe distance is shown in FIG. 1A, although the openings in the housing 36 are not visible.

Figure 9:
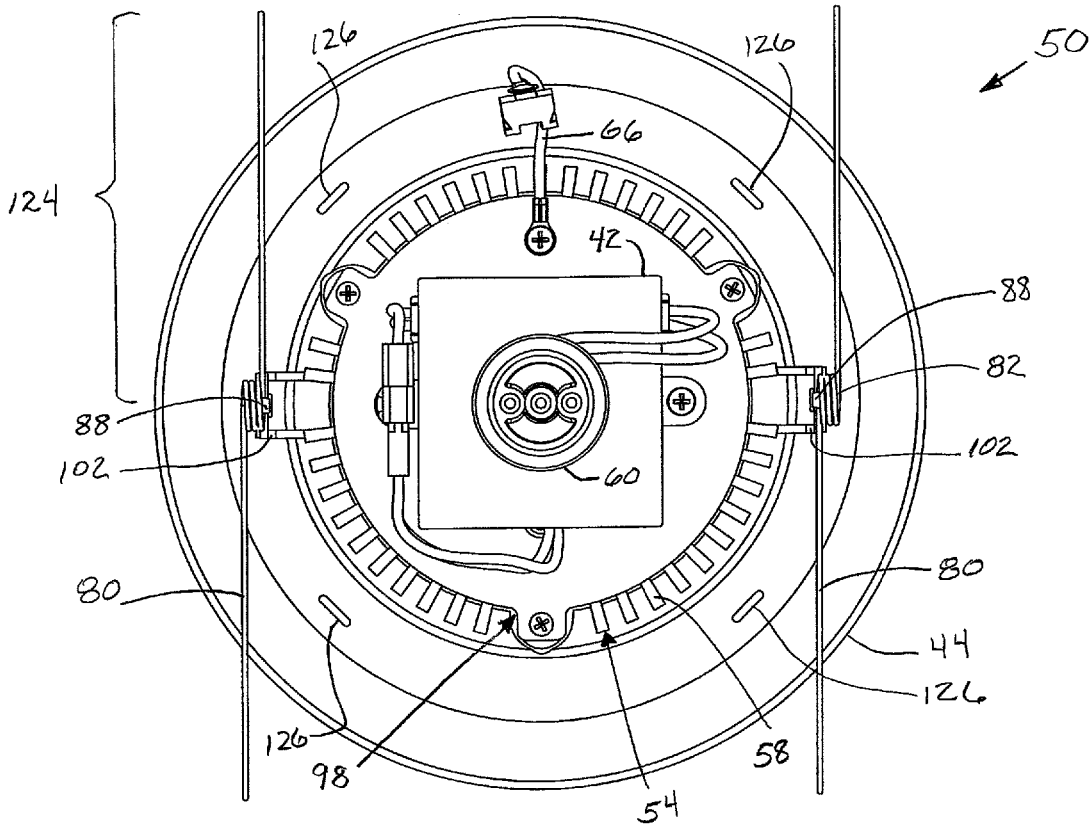
FIG. 9 is a top view of the trim unit of FIG. 5 in which the light source is fixed in position, showing the attachment of the electrically conductive mounting springs to the trim unit, the driver unit, the light socket adapter that may be screwed into a standard electrical light socket for receiving electrical power, the ground strap, and the heat radiating fins located on the integrated baffle/heat sink.

FIG. 9 shows a top view of the trim unit 50 showing the light socket adapter 60, driver unit 42, baffle 98 with integrated heat sink 54 having heat dissipation fins 58, elongated springs 80 for mounting the trim unit to the housing as shown in FIG. 8, and a ground strap 66. The three coils 82 of the spring about the mounting bracket 102 are visible as is the bent tab 88 holding the springs in position on the brackets which permit the springs to engage the integrated baffle 98 and heat sink 54 combination to support the trim unit 50 while it is mounted within the recessed housing. The rectangular cross-section shape of the heat sink fins 58 can be seen from FIG. 9, although other embodiments may use fins having different cross-sectional shapes such as trapezoidal. Insulation spacers 126 are shown about which an insulation ring may be located. Such an insulation ring would be located between the trim ring 44 and the opening 32 of the surface 30 in which the recessed lighting fixture 34 is mounted to insulate the temperature of the space 51 in which the recessed lighting fixture is located from the temperature of the room 47 or other space into which illumination from the light fixture is directed. See FIG. 1A.

Figure 10:
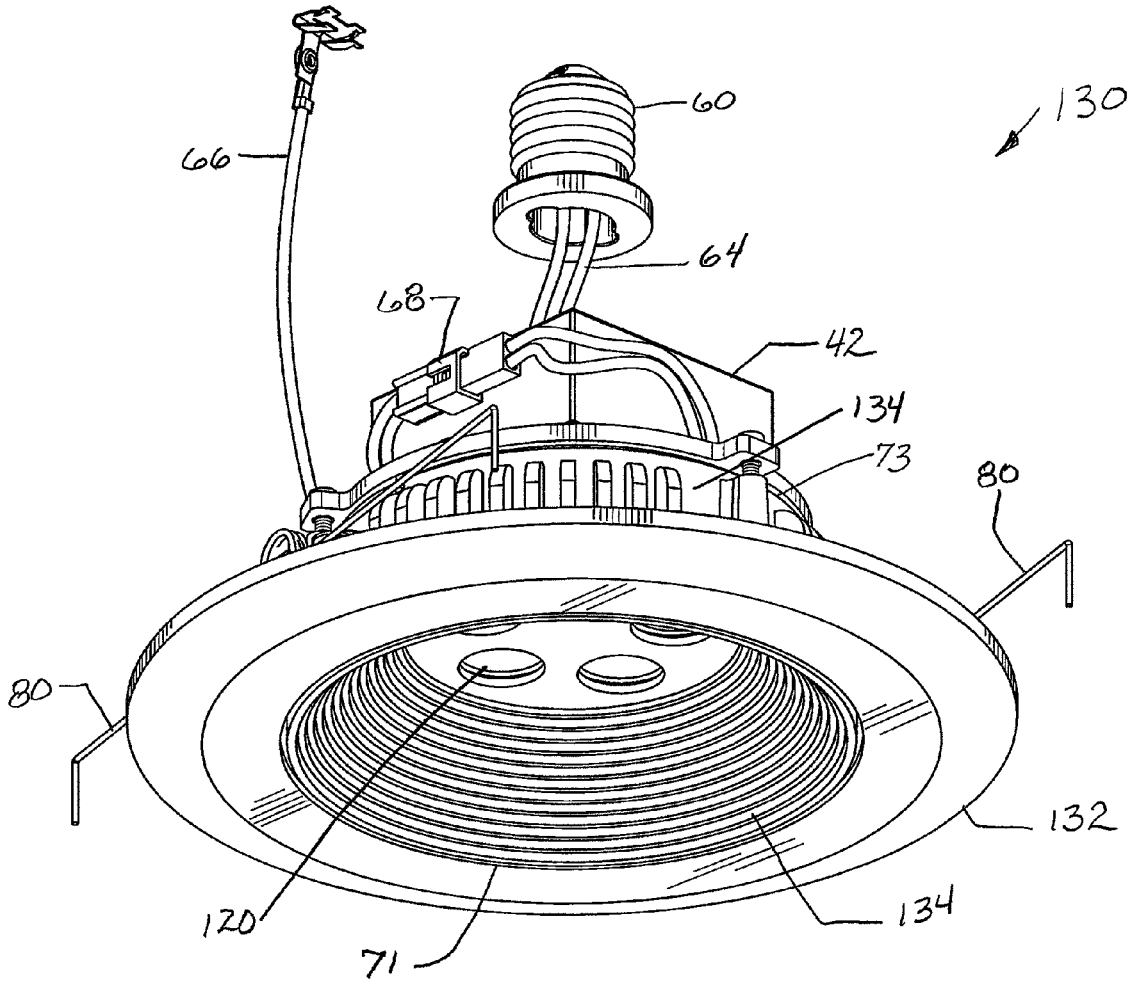
FIG. 10 is a bottom perspective view of a gimbaled trim unit that can be tilted in elevation and swiveled in azimuth to enable selection of the aim of the light source, showing the trim ring, the baffle with integrated heat sink, a plurality of LED lights, a driver to provide power to the lights, a ground strap, a light socket adapter, and electrically conductive mounting springs.
Figure 11:
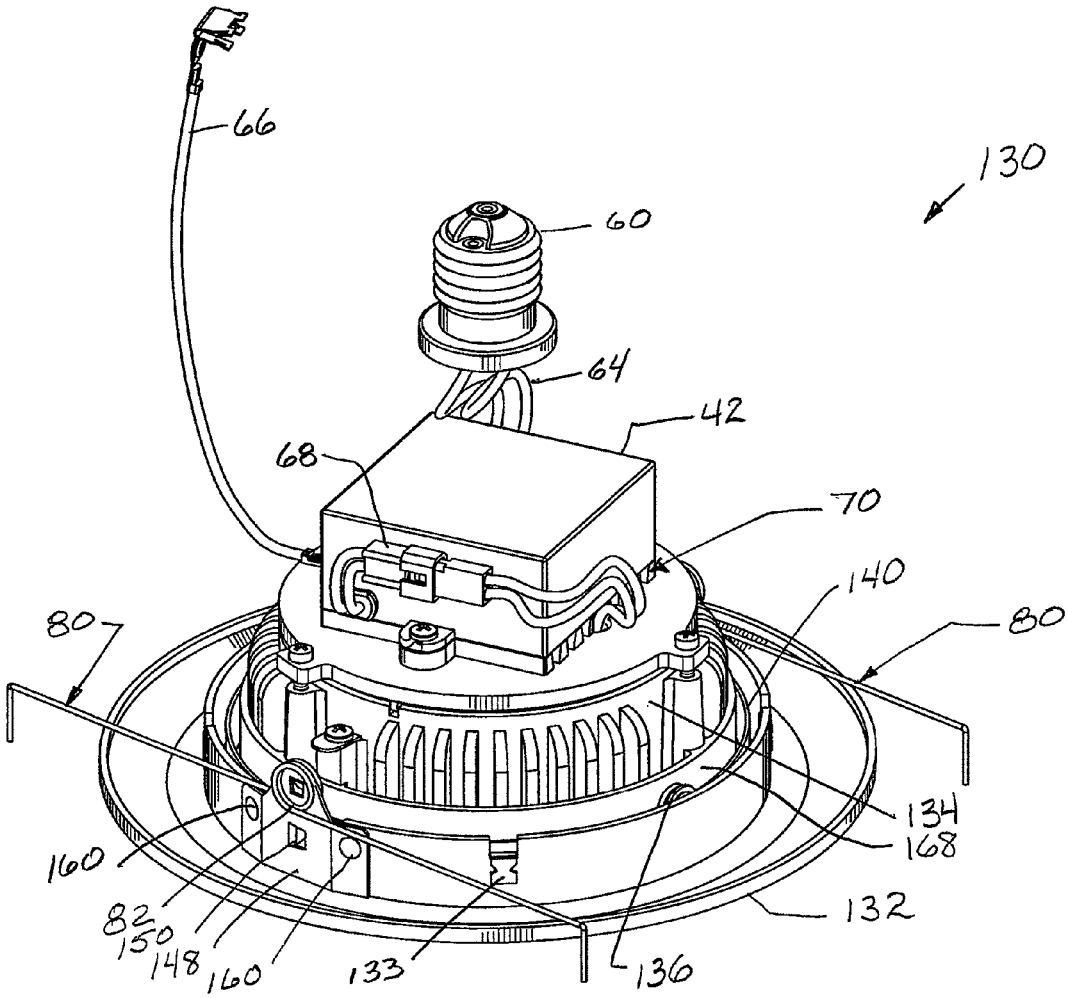
FIG. 11 is a top perspective view of the gimbaled trim unit shown in FIG. 10 showing more detail of a gimbals mechanism permitting the tilting of the trim unit to control the elevational aim of the light source and rotation of the integrated baffle/heat sink device to control the azimuthal aim of the light source, also showing the electrically conductive mounting springs, the driver, and a second heat sink disposed between the driver and the LED lights to further draw heat away, the view also showing the integrated baffle/heat sink in contact with a trim ring to assist in drawing heat away from the light source.

In the embodiment of FIGS. 10 and 11, bottom and top perspective views of a gimbaled trim unit 130 that can be tilted in elevation and swiveled in azimuth to enable selection of the aim of the light source is shown. A trim ring 132 is provided although it is not formed as a single piece with the trim ring in this gimbaled embodiment. As seen in FIG. 10, the baffle 134 is frusto-conical in shape. Mounting/grounding springs 80 are also provided as in the other embodiments. Also, a light socket adapter 60 with wires 64, grounding strap 66, connector 68, and driver unit 42 are provided also, as in other embodiments. However, in this embodiment, the baffle 134 and the light source 120 are movable, or gimbaled, in relation to the trim ring 132 so that the light source may be tilted to control the elevational aim of the light source and swiveled so that the azimuth position can be selected to permit accurate aiming of the light source. One of the pivot points of the tilt axis of the gimbal device is provided by a rivet 136 as can be seen in FIG. 11. The rivet 136 fixedly connects the gimbal mounting flange 168 of the integrated baffle/low profile heat sink to a rotation ring 140. An outer edge 143 of the rotation ring 140 rests on an inner ledge 145 of the trim ring 132 (seen in FIG. 13) so that the rotation ring can be freely rotated in relation to the trim ring 132 about an axis extending vertically through the assembly shown in FIG. 13. The rotation ring is prevented from being pulled off the ledge of the trim ring 132 by clips 133. Thus a complete gimbal mounting is provided that permits the baffle/low profile heat sink 134 and surrounded light source 120 to tilt for elevation aim control and swivel for azimuth aim control in relation to the trim ring 132.

Figure 12:
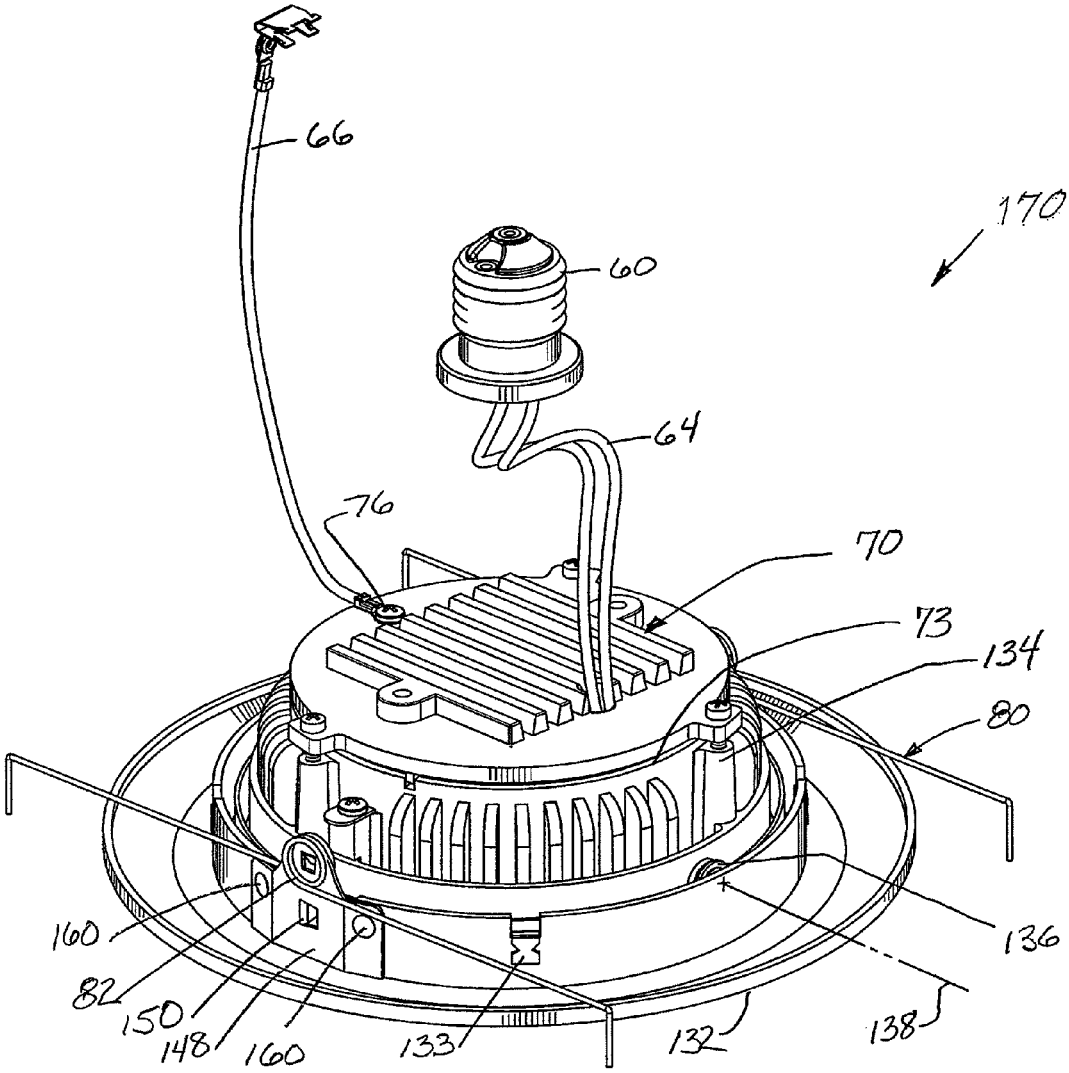
FIG. 12 is a further embodiment of a gimbaled trim unit that may both be tilted for elevational aim control and swiveled for azimuthal aim control, also demonstrating the optional use of a driver in that the light emitting diodes of this embodiment do not require a driver, hence none has been installed at the trim unit resulting in the figure more clearly showing the second heat sink at the end of the baffle.

Turning now additionally to FIG. 12, a further embodiment of a trim unit 170 shown in FIG. 11 is provided. The embodiment of FIG. 12 demonstrates the optional use of a driver for the LEDs. In this embodiment, the LEDs do not require a driver, hence none has been installed at the trim unit. As a result, the second heat sink 70 located at the second end 73 of the baffle is more visible. A gimbal axis 138 is formed by the rivet 136 for the tilt control of the integrated baffle/heat sink device 134. As shown in FIG. 12, the visible rivet 138 has an enlarged head that does not touch the inside surface of the trim ring, but will touch the rotational control device 150 which comprises a tab 150 that is bent inward from the spring support bracket 148. This tab provides an obstacle to the rivet head 138 of the rotation ring 140 and will prevent rotation of the rotation ring and baffle past the point of contact with the bent tab. There are two spring support brackets located diametrically opposite each other (see FIG. 13). If both have tabs 150 bent inward, the rotation ring will be limited to one-hundred and eighty degrees of rotational movement. If only one bracket has a bent tab, the rotation ring will be limited to three hundred and sixty degrees of rotational movement.

In this case, each spring support bracket is attached to the trim ring 132 by two electrically conductive and thermally conductive rivets 160. Because the baffle/heat sink device 134 is riveted to the rotation ring, which rests on a portion of the trim ring, heat and electrical charge on the baffle/heat sink will be conducted to the trim ring and to the springs 80. The springs will conduct that electrical charge to the housing in which the trim unit 130 is mounted, and the heat will be conducted by the trim ring to the room or space in which it is located, as described previously.

Figure 13:
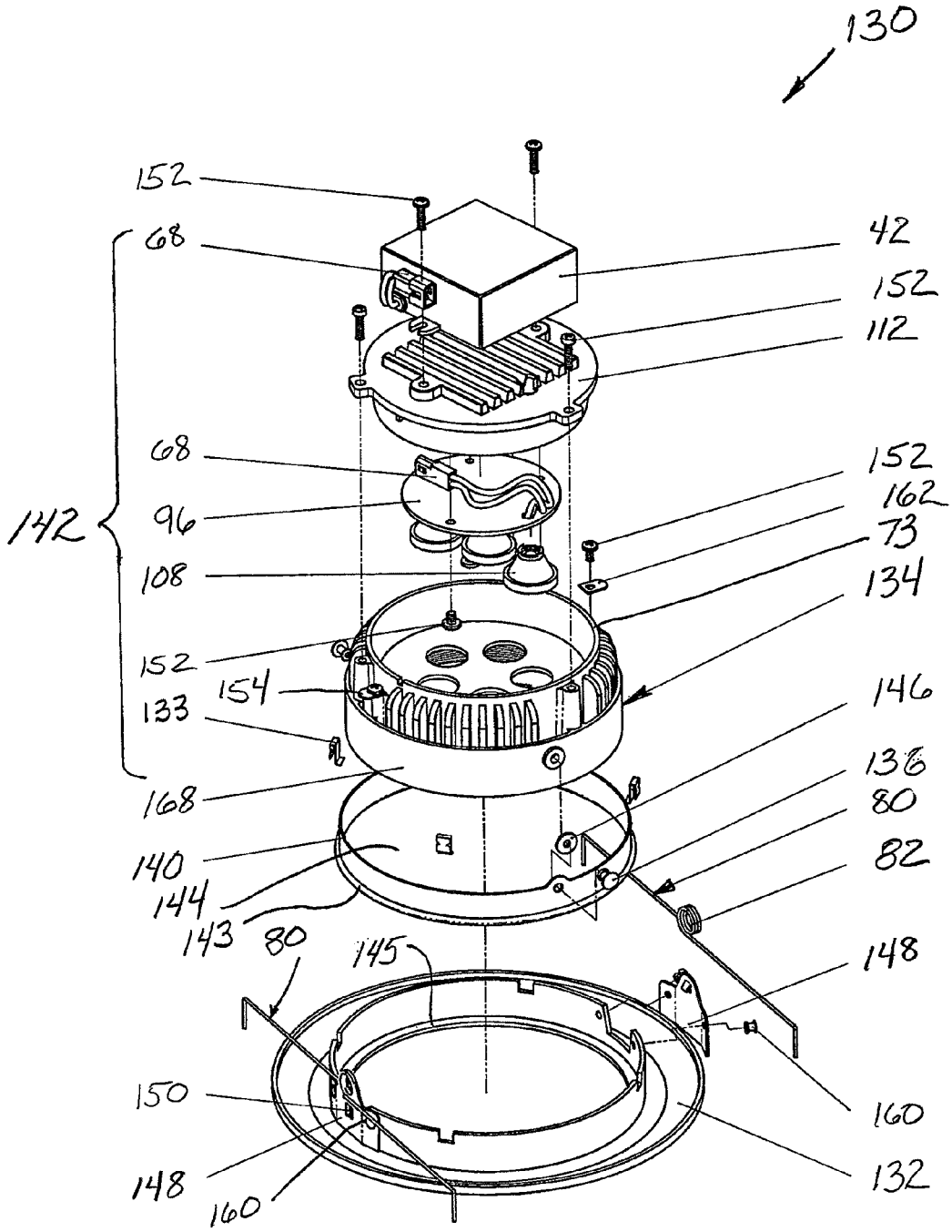
FIG. 13 is an exploded view of the gimbaled trim unit of FIGS. 10 and 11 showing in detail the gimbals mechanism that provides the ability to aim the light source through tilting and rotating, the LED light sources and lenses, the integrated baffle/heat sink, the trim unit end cup with integrated heat sink, the driver unit, and the electrically conductive mounting springs.

Turning now to FIG. 13, an exploded view of the trim unit 130 of FIG. 11 is presented. The gimbal tilt axis 138 (see FIG. 12) is established by two opposite pivot points for the baffle/heat sink/light source apparatus 142. One pivot point is shown as being created by the rivet 136 which is used to fasten the rotation ring 140 to the gimbal flange 168 of baffle/heat sink 134. A gimbal washer 146 is placed between the rotation ring and the flange 168. The rotation ring has an open bottom 144 to accommodate the tilting of the baffle/heat sink, 134, as will be seen in later drawings. In this embodiment, the rivet 136 has a long neck that extends outward from the rotation ring for control over the amount of rotation as discussed above. The spring mounting bracket 148 at the lower left of both drawings includes the tab 150 that is bent inward towards the rotation ring. As previously discussed, this bent tab prevents rotation of the rotation ring 140 and baffle/heat sink 134 beyond contact with the tab. Rotating the rotation ring permits control over the azimuth direction of the light source thereby permitting accurate aiming both in an elevational direction and in the azimuth direction of the light source.

The spring brackets 148 are riveted to the trim ring 132 in this embodiment with rivets 160, although other means may be used. Various screws 152 are used to mount the parts together, as shown. Stoppers 154 are provided. The lenses 108 over the LED lights are shown as well as the printed circuit board 96 on which the LEDs are mounted according to methods well know to those of skill in the art.

Figure 14:
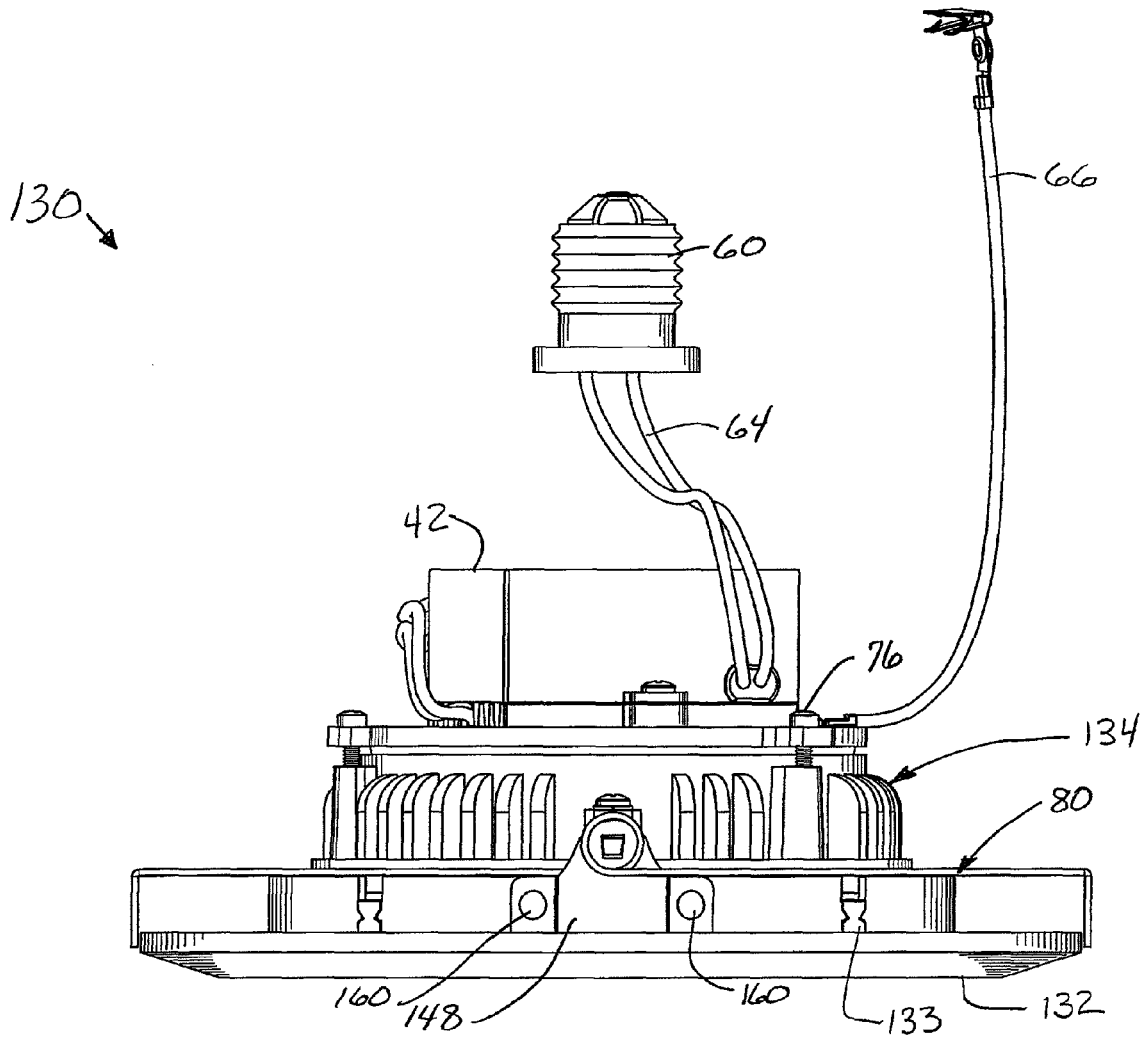
FIG. 14 is a side view of the trim unit of FIGS. 10 and 11 showing a grounding strap for connection to a grounded recessed housing, and a light socket adapter for engaging mains power for use in powering the light source.
Figure 15:
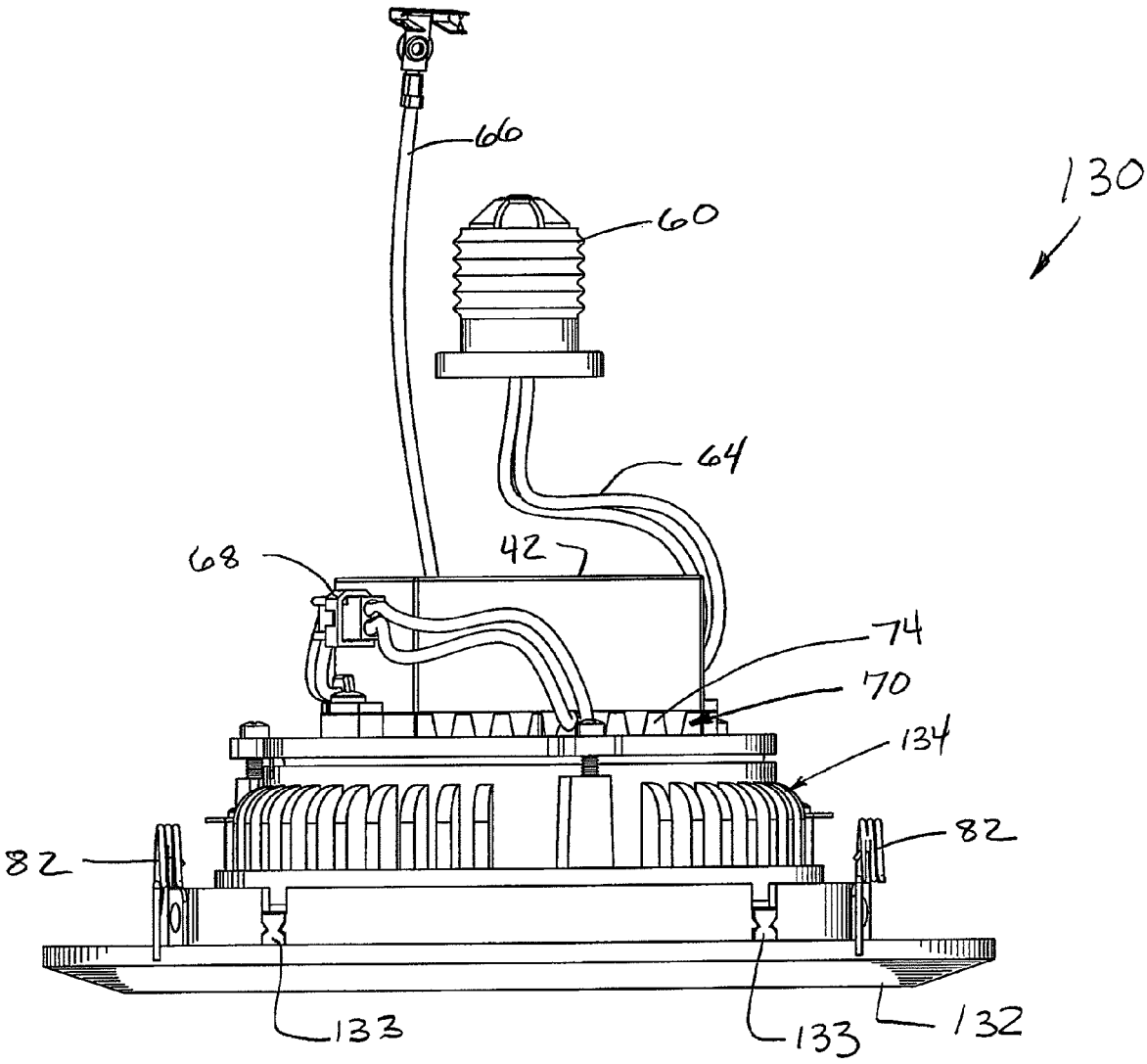
FIG. 15 is a side view of the gimbaled trim unit of FIGS. 10, 11, and 14 rotated ninety degrees from FIG. 14 showing more clearly the attachment of the electrically conductive mounting springs.

FIGS. 14 and 15 provide side views of the trim unit 130 of FIGS. 10 and 11 rotated by ninety degrees from each other. Both have a drive unit 42 mounted on a second heat sink that is formed as single piece with the baffle trim cup.

Figure 16:
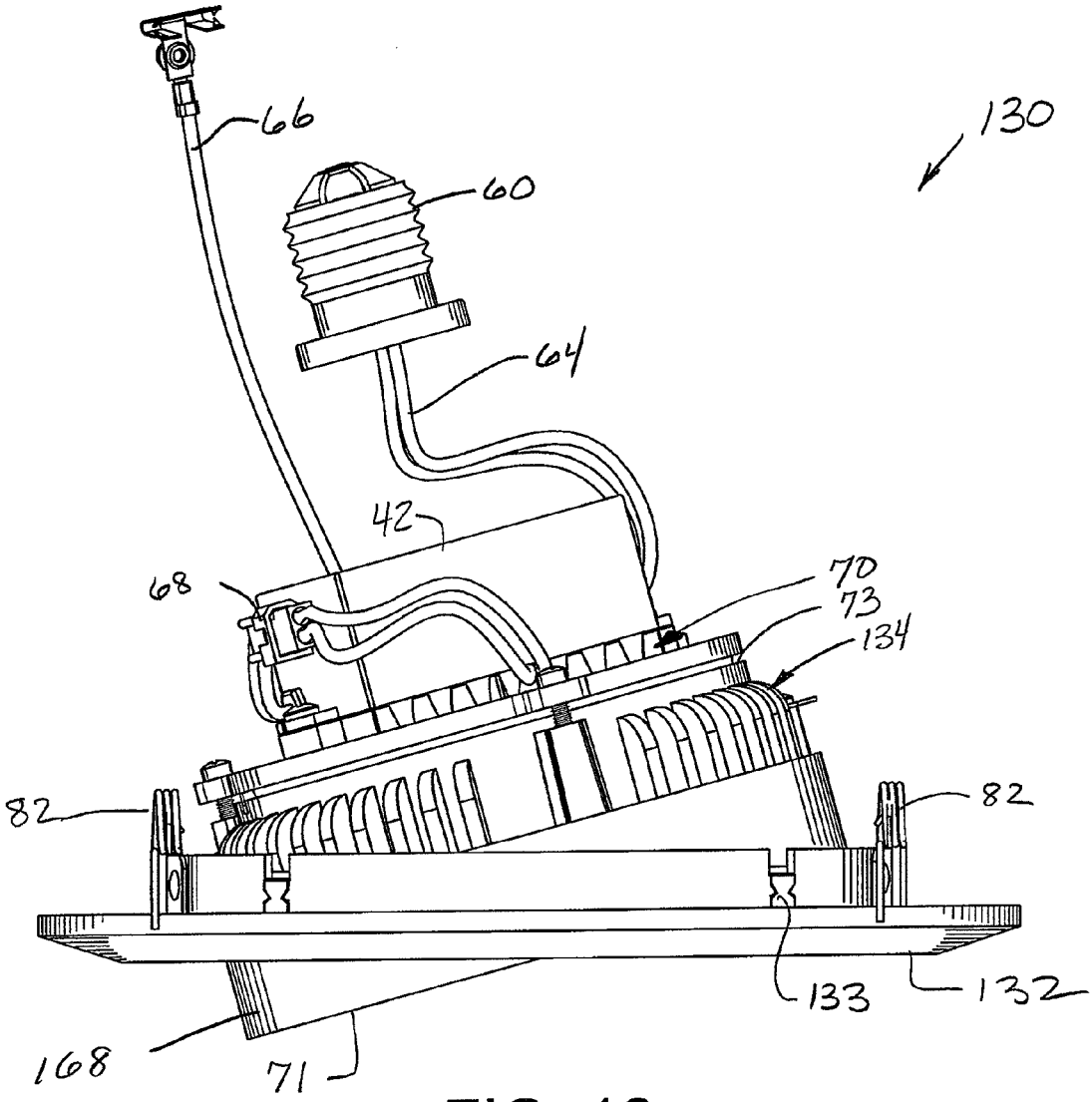
FIG. 16 is a side view of FIG. 15 in which the gimbaled trim unit has been selectively tilted by approximately fifteen degrees to aim the light from the light sources at a selected location.
Figure 17:
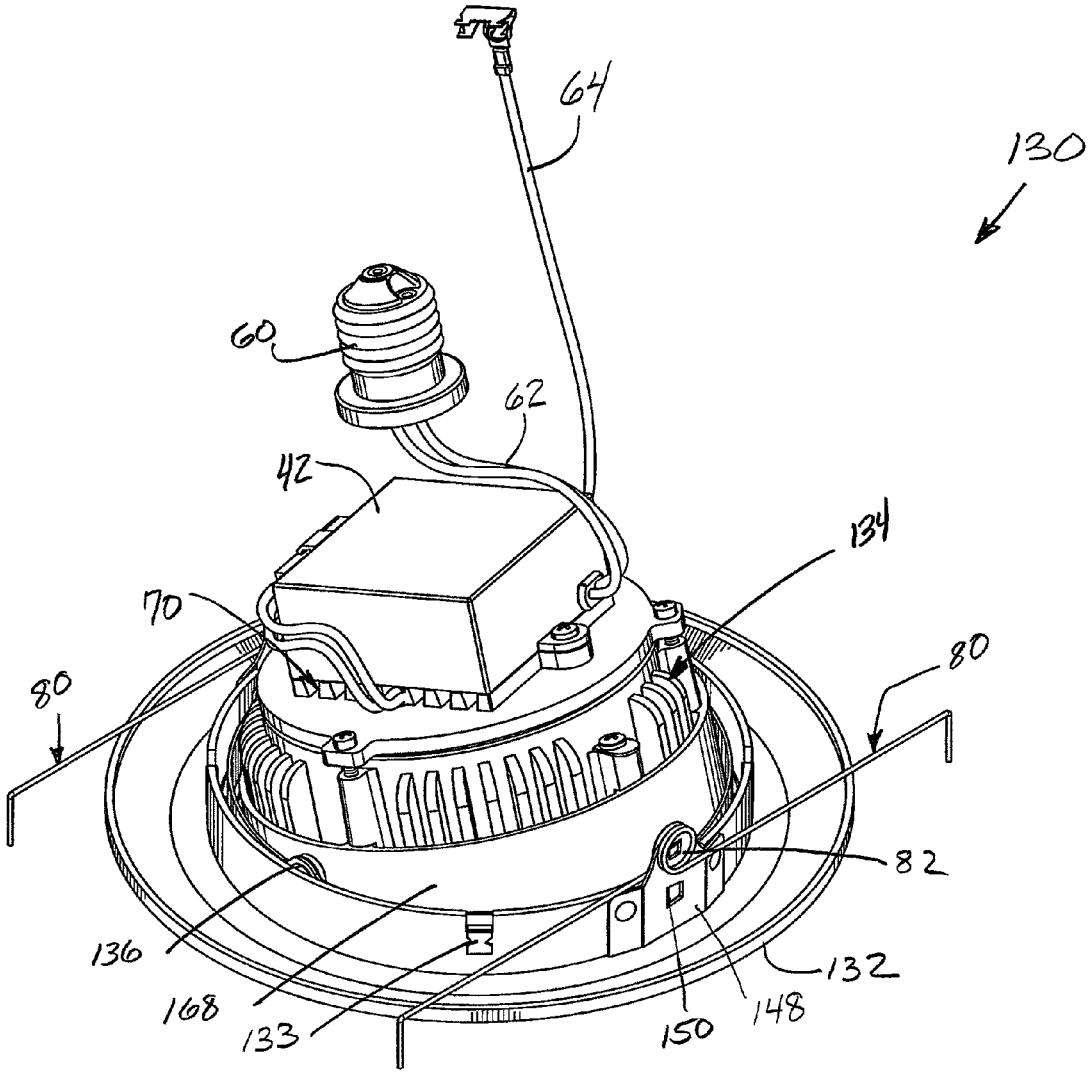
FIG. 17 is a top perspective view of the tilted gimbaled trim unit of FIG. 16, the view being rotated at an angle from that shown in FIG. 16 to show the gimbaled tilt axis and the stop device for limiting the azimuthal aiming of the light source.

FIGS. 16 and 17 show the trim unit 130 tilted by approximately fifteen degrees in relation to the trim ring 132. FIG. 16 provides a side view while FIG. 17 provides a top perspective view of the same configuration of the trim unit as FIG. 16. In FIG. 16, the baffle gimbal mounting flange 168 can be seen tilted below the level of the trim ring 132 thus clearly demonstrating that the light source may be selectively aimed. The baffle gimbal mounting flange 168 received the rivet 136 (see FIG. 17) used to form part of the gimbal mounting of the baffle to the trim ring. Accordingly, the trim unit 130 pivots about a diameter of the trim ring 132.

Figure 18:
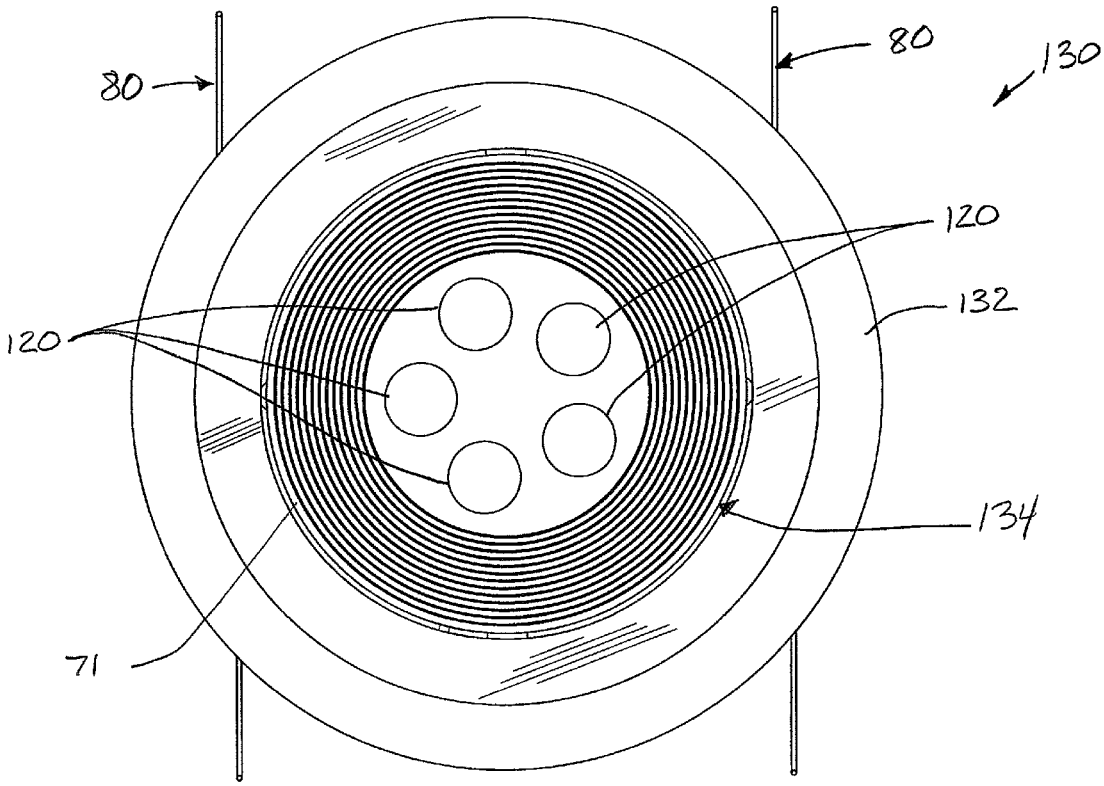
FIG. 18 is a bottom view of the gimbaled trim unit of FIG. 16 showing five LED light sources, the trim ring that is located on the outer side of the planar surface within which the recessed light fixture is mounted, the baffle, and the electrically-conductive mounting springs for securing the gimbaled trim unit in a housing.

FIG. 18 provides a bottom view of the trim unit 130 of FIG. 16 showing five LED light sources 120 and the trim ring 132 that is located on the outer side 46 of the planar surface 30 within which the recessed light fixture 34 is mounted (see FIG. 1A).

Figure 19:
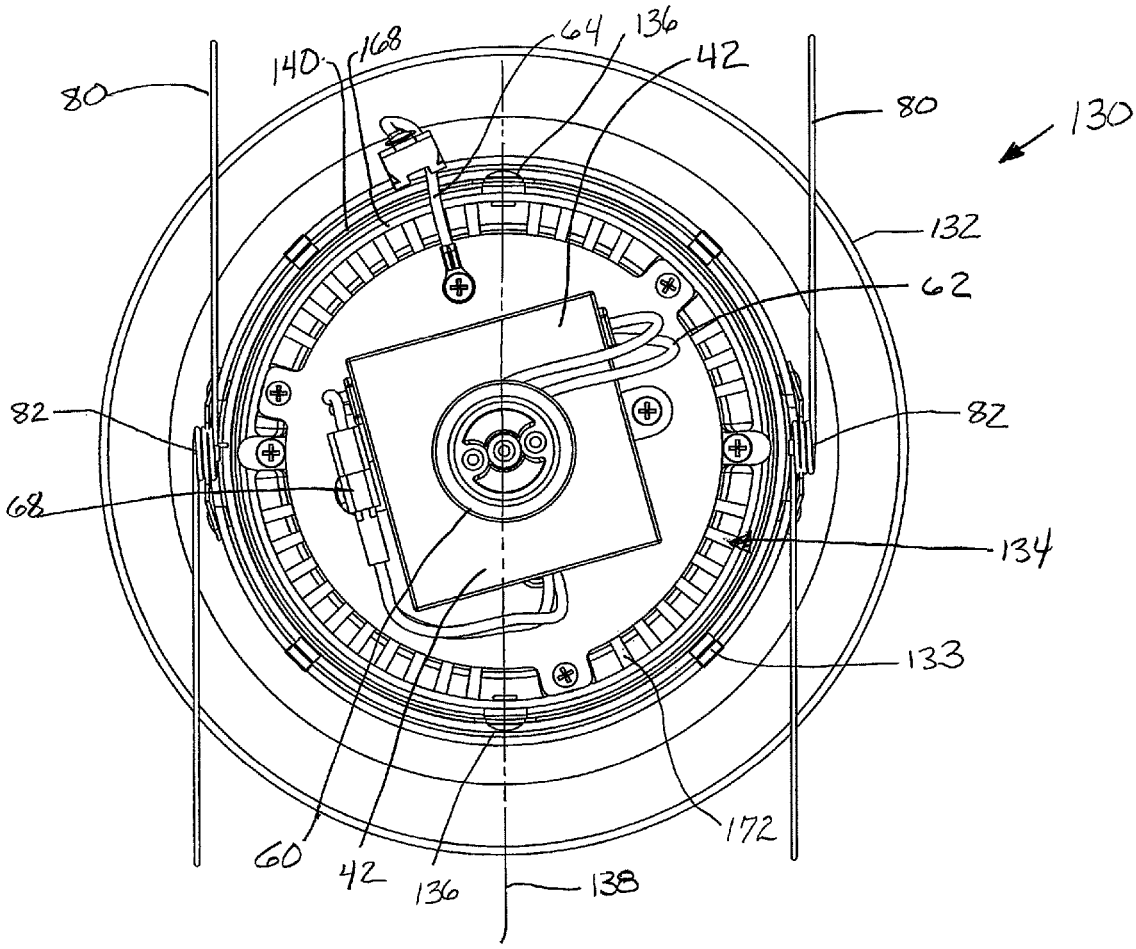
FIG. 19 is a top view of the gimbaled trim unit of FIG. 18 showing the electrically conductive mounting springs, the driver unit, the integrated baffle/heat sink, the light socket adapter that may be screwed into a standard electrical light socket, and the heat radiating fins located on the integrated baffle/heat sink.

FIG. 19 is a top view of the gimbaled trim unit 130 of FIG. 18. The tilt gimbal axis 138 is shown and is established by the rivets 136 that fix together the rotation ring 140 with the gimbal mounting flange 168. Also shown are the electrically conductive mounting springs 80, the drive unit 42, and the baffle/heat sink 134 showing the heat sink fins, one of which is indicated by numeral 172.

Thus, there has been provided an improved recessed lighting fixture having a low profile heat sink 56 integrated with the baffle 54 of a trim unit 50. The heat sink is part of the baffle, and draws heat out of the recessed housing 36. In one embodiment the baffle also includes the trim ring as a single part. Together they work to release heat into the room below and outside of the recessed housing. In a gimbal trim unit, the trim ring is not part of the baffle but even so, the heat is drawn out of the recessed housing and into the room below. Metal to metal contact occurs throughout, such as where the frusto-conical shaped LED trim cup 72 is attached to the frusto-conical shaped baffle 54 to effect heat transfer from the LED trim cup to the baffle drawing heat away from the LED trim cup and into the heat sink of the baffle, and in turn emitting this heat into the atmosphere of the room 47.

Figure 20:
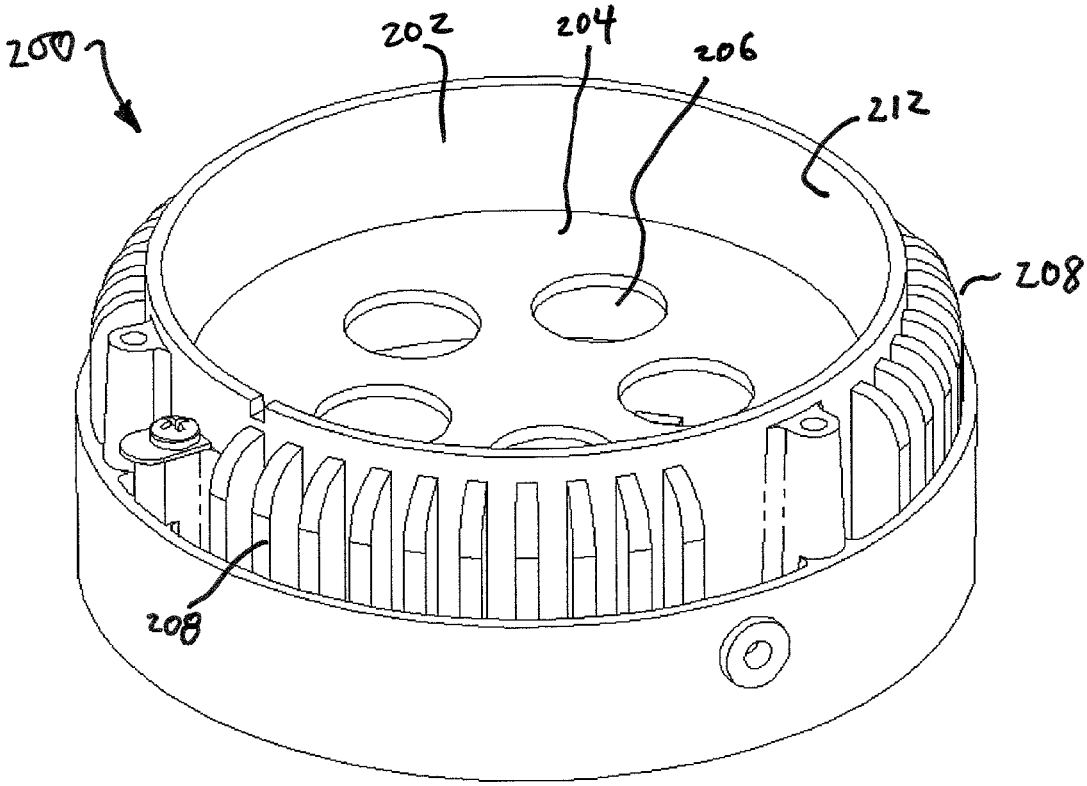
FIG. 20 is a bottom perspective view of one embodiment of a baffle/heat sink.

FIG. 20 is a top perspective view of an alternative embodiment baffle with integrated heat sink 200. This embodiment of the baffle/heat sink 200 is very similar in construction to the baffle/heat sink shown in FIG. 2 (part 56) or FIG. 13 (part 134). Baffle 200 has an overall puck or cup shape with a frusto-conically shaped cavity 202 having a bottom 204 with holes 206 therein. The number, size and location of the holes 206 correspond to the number, size and location of the LED array 57 shown in FIG. 2, for example. Heat sink fins 208 are dispersed radially around the exterior circumference of the cavity 202 and are formed as part of and integral with the baffle 200. This preferred embodiment one-piece formation maximizes contact with the baffle for greatest heat transfer to the fins 208 via conduction. In alternative embodiments, the heat sink fins may be assembled to the baffle 200, using rivets, welds, brazes, etc. but the assembly approach would conduct thermal energy less efficiently due to less surface contact or the intervening material would not conduct heat as well.

As in other embodiments, the baffle/heat sink 200 is formed from a single piece of cast aluminum. The mold, preferably a die cast type, is fairly complex to form each of the individual fins 208. The baffle/heat sink 200 is preferably painted or coated in a color to match the color or finish of the trim ring 52 such as that shown in FIGS. 2, 3.

FIGS. 21, 22 show a top perspective view and a bottom perspective view, respectively, of a trim unit top which in this embodiment is in the form of a trim cup 112, also shown in FIG. 5. On one side of the trim cup 112 is a low profile heat sink 70 as seen in FIGS. 5 and 21. The low profile heat sink 70 may be cast in one piece with the trim cup 112, or as seen in FIG. 5, the heat sink 70 is assembled to the trim cup 112 via screws, rivets or like fasteners. The low profile heat sink 70 preferably has a trapezoidal cross-sectional shape with its height slightly taller than the width of its base, which proportions promote cooling air flow between each fin. For that same reason, the fins are arranged in parallel rows as seen in FIG. 21. Finally, the dimensional footprint of the heat sink 70 corresponds to the footprint of the LED driver unit 62 so the latter completely overlies and covers the former for a larger contact surface for better thermal conduction, as seen in FIG. 3 for example. The low profile heat sink 70 thus draws away heat from the driver unit 62 overhead and the LED array 57 underneath.

The trim cup 112 and heat sink 70 are preferably made from aluminum castings and preferably painted or coated again to match the color or finish of the trim ring 52. A circular wall 210 circumscribes the trim cup 112 to give it a cup shape. When the trim cup 112 is assembled to the baffle 200, this circular wall 210 fits inside the cavity 202 of the baffle 200 and the wall 210 is in direct contact with the interior wall 212 of the baffle 200. This is best seen in the cross-sectional view of FIG. 25 taken along a diameter of the baffle 200. The large surface areas of direct contact between walls 210 and 212 enable good thermal conduction of heat away from the LED array 57 and its driver unit 62. The low profile heat sink 70 enables thermal cooling via radiation, convection, and conduction to the ambient environment and surrounding structures. The low profile design of the heat sink 70 allows the LED driver unit 62, if one is required and which heats up during use, to be mounted directly thereon yet still maintain a compact vertical dimension as seen in FIG. 3 for example. This direct contact between the driver unit 62 and the heat sink 70 improves thermal cooling of the driver unit 62.

Figure 25:
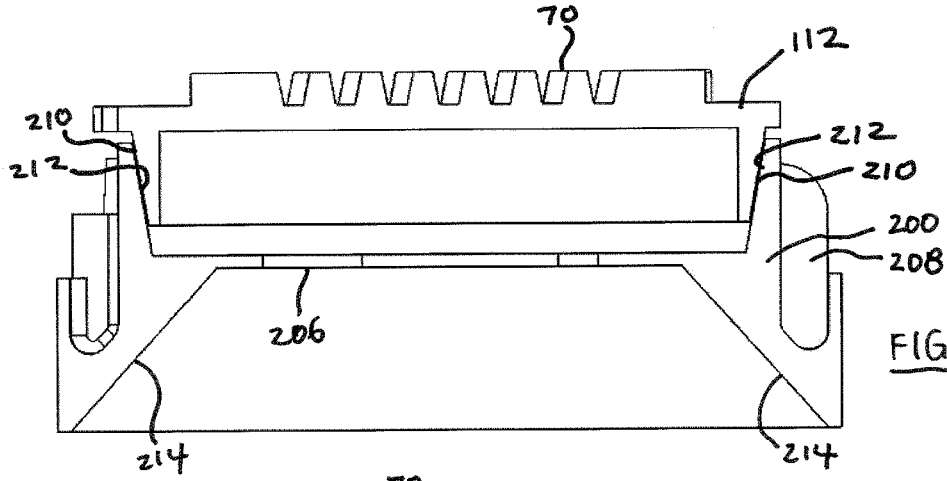
FIG. 25 is a cross-sectional view of a trim unit showing where the top is assembled to the baffle, and the top includes a circular wall.

As seen in FIG. 25, the bottom of the baffle 200 has a frusto-conical cavity bounded by a sloped wall 214 that acts as a reflector for the LED light emitted through holes 206. The sloped wall 214 may be smooth or stepped as seen in the embodiment of FIG. 2 for example. The sloped wall 214 is optionally covered with a light color, reflective paint or coating to help diffuse the light emitted from the LED array.

Figure 26:
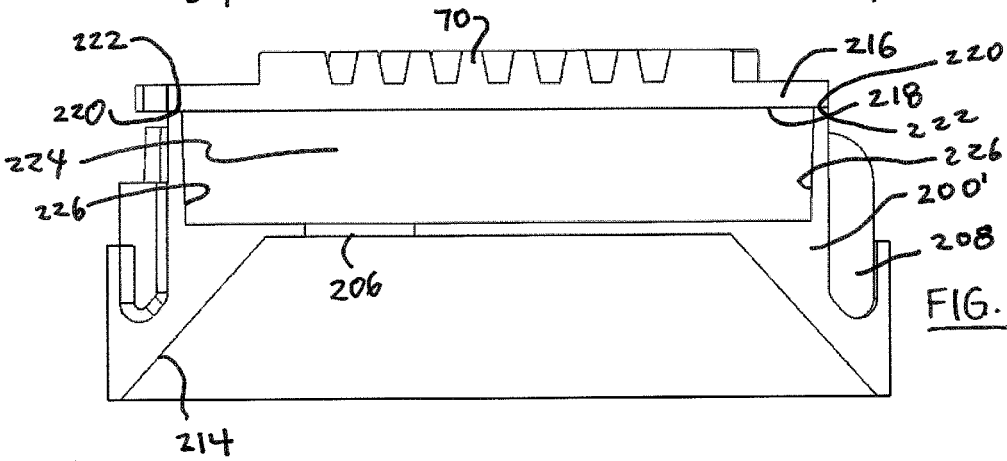
FIG. 26 is a cross-sectional view of a trim unit where an alternative embodiment top is assembled to the baffle, and the top is a flat disk.

FIG. 23 is a bottom perspective view of an alternative embodiment top 216 of the trim unit. FIG. 24 is a side elevational view of the alternative embodiment trim unit top 216 assembled to the baffle 200', and FIG. 26 is a cross-sectional view of the trim top 216 assembled to the baffle 200' where the cross-section is taken along a diameter of the baffle 200'. The alternative embodiment trim top 216 has a smooth bottom face 218 while the opposite face includes a low profile heat sink 70. The heat sink 70 is preferably formed in one piece with the trim top 216. Again, the components are preferably made from cast aluminum, but this component with the flat disk design may be a piece of stamped metal. Of course, the heat sink 70 in an alternative embodiment may also be a discrete component that is fastened to the trim top 216 by use of fasteners such as in FIG. 5.

Notably, the smooth bottom face 218 of the trim unit top 216 (FIG. 23) does not have a circular wall 210 as in the trim cup embodiment 112 (FIG. 22). The trim unit top 216, now a flat, circular disk, is assembled to the LED array, wiring and surrounding hardware in the same manner as with the trim cup embodiment 112 shown in FIG. 5. As seen in FIG. 26, with the omission of the circular wall, the trim top 216 seats lower on the baffle 200'. As a result, the overall height dimension of the trim unit is further reduced and is readily apparent when comparing the embodiments of FIG. 26 versus FIG. 25.

As seen in FIG. 26, a circumferential lip 220 of the trim top 216 engages the upper edge 222 of the baffle 200'. Furthermore, the interior cavity 224 of the baffle 200' is no longer frusto-conical shaped but more cylindrically shaped. As such, the interior wall 226 is fairly vertical and not sloped as in the embodiment shown in FIG. 25. There is, however, a slight draft angle to the wall 226 if the part is cast so that it can be separated from the mold.

Effective thermal conduction is still achieved by the direct contact between the upper edge 222 of the baffle 200' and the circumferential lip 220 of the trim unit top 216. The extra room inside the cylindrically shaped cavity 224 allows more ambient air to pass through for better convection cooling.

Moreover, the cylindrically shaped cavity 224 creates more space inside the baffle 200' and this extra space can be occupied by additional LEDs, larger sized LEDs, or a combination of both and their additional wiring. More LEDs, larger LEDs, or fewer but larger LEDs increase the lumens output by the light fixture which may be an attractive feature to the consumer. More cavity space 224 in the baffle 200' further enables flexible arrangements of the LEDs aside from a ring pattern as shown, such as in a matrix, a diamond, rows, crisscross, etc. The intensity and light patterns projected by such arrangements of LEDs can therefore be adjusted or changed to suit the consumer.

Although the present invention has been described in terms of certain preferred embodiments, other embodiments that are apparent to those of ordinary skill in the art are also within the scope of the invention. Accordingly, the scope of the invention is intended to be defined only by reference to the appended claims. While variations have been described and shown, it is to be understood that these variations are merely exemplary of the present invention and are by no means meant to be limiting.

We claim:

1. A recessed lighting fixture located in an opening of a surface, the surface having an outer side and an inner side, the lighting fixture comprising:

a circular trim ring including attachment springs;

a lighting trim unit assembled to the trim ring, the trim unit disposed at the opening on the outer side of the surface, wherein the trim unit includes:

a trim top having at least one of a circular flat plate only and a circular flat plate including a circular wall;

a light source that emits light disposed on the trim top to emit light toward the outer side of the surface;

a cup shaped baffle having a first end oriented proximate to the outer side and a second end located proximate to the inner side opposite the first end, the baffle having a wall surrounding the light source at the second end and a lip of the wall engaging the trim top, and having a frusto-conical portion at the first end, wherein the light emitted from the light source reflects against the frusto-conical portion toward the outer side of the surface;

a low profile heat sink disposed along the surrounding wall of the baffle along an exterior thereof, wherein the heat sink draws heat out of the light source.

2. The recessed lighting fixture of claim 1, wherein the baffle wall surrounding the light source includes a cavity having a frusto-conical cross-section.

3. The recessed lighting fixture of claim 1, wherein the baffle wall surrounding the light source includes a straight sided wall on an exterior face and a slight draft angled wall on an interior face.

4. The recessed lighting fixture of claim 1, wherein the trim top and the baffle are formed together as a single part.

5. The recessed lighting fixture of claim 1, wherein the fixture includes a rotation ring and the lighting trim unit is assembled to the rotation ring, and the rotation ring slidably engages the trim ring so that the lighting trim unit rotates relative to the trim ring.

6. The recessed lighting fixture of claim 5, wherein the lighting trim unit is attached to the rotation ring via hinges so that the trim unit pivots about a diameter of the trim ring.

7. The recessed lighting fixture of claim 1, wherein the baffle includes a heat sink having fins that protrude radially outward and are oriented in parallel with a longitudinal axis of the baffle.

8. The recessed lighting fixture of claim 1, wherein the light source includes an LED.

9. The recessed lighting fixture of claim 8, wherein the light source includes a driver unit powering the LED, and the trim top includes a heat sink and the driver unit is disposed on the heat sink.

10. The recessed lighting fixture of claim 1, wherein the fixture includes a can housing, and the trim ring attachment springs fit against the can housing and the trim unit fits at least partially inside the can housing.

11. A recessed lighting fixture located in an opening in a ceiling, the ceiling having an outer side and an inner side, the lighting fixture comprising:

a circular trim ring including attachment springs;

a lighting trim unit assembled to the trim ring to enable two axes of rotation relative to the trim ring, the trim unit disposed at the opening on the outer side of the ceiling, wherein the trim unit includes:

a trim top having at least one of a circular flat plate only and a circular flat plate including a circular wall;

an LED array that emits light disposed on the trim top to emit light toward the outer side of the ceiling;

a cup shaped baffle having a first end oriented proximate to the outer side and a second end located proximate to the inner side opposite the first end, the baffle having a wall surrounding the LED array at the second end and an edge of the wall engaging the trim top, and having a frusto-conical portion at the first end, wherein the light emitted from the LED array reflects against the frusto-conical portion toward the outer side of the ceiling; and a low profile heat sink disposed along the surrounding wall of the baffle along an exterior thereof, wherein the heat sink draws heat out of the LED array.

12. The recessed lighting fixture of claim 11, wherein the heat sink of the cup shaped baffle includes a plurality of radial fins.

13. The recessed lighting fixture of claim 11, wherein the trim top includes a second low profile heat sink having trapezoidal shaped fins arranged in parallel rows, located at an exterior surface thereof and in contact with the LED array.

14. The recessed lighting fixture of claim 11, wherein the lighting trim unit is slidably disposed on the trim ring to rotate coaxially relative to the trim ring, and the trim unit is hinged to the trim ring to pivot about a diameter of the trim ring.

15. The recessed lighting fixture of claim 11, wherein the fixture includes a can housing that receives the lighting trim unit at least partially therein, and the can housing is attached to the trim ring via the attachment springs, and wherein the can housing is located at the opening in the ceiling extending into the inner side.

16. The recessed lighting fixture of claim 11, wherein the circular wall of the trim top slidably engages the surrounding wall of the baffle, which surrounding wall defines a cavity having a frusto-conical cross-section.

17. The recessed lighting fixture of claim 11, wherein the trim top is a circular flat plate that engages an upper edge of the surrounding wall of the baffle, which surrounding wall includes a straight sided wall on an exterior face and a slight draft angled wall on an interior face.

18. A recessed lighting fixture located in an opening in a ceiling, the ceiling having an outer side and an inner side, the lighting fixture comprising:

a circular trim ring including attachment springs;

a lighting trim unit assembled to the trim ring, the trim unit disposed at the opening on the outer side of the ceiling; wherein the trim unit includes:

a trim top having a circular flat plate shape;

an LED array that emits light disposed on the circular flat plate top to emit light toward the outer side of the ceiling;

a cup shaped baffle having a first end oriented proximate to the outer side and a second end located proximate to the inner side opposite the first end, the baffle having a wall surrounding the light source at the second end and a lip of the wall engaging the trim top, and having a frusto-conical portion at the first end, wherein the light emitted from the LED array reflects against the frusto-conical portion toward the outer side of the ceiling; and a low profile heat sink disposed along the surrounding wall of the baffle along an exterior thereof, wherein the heat sink draws heat out of the LED array.

19. The recessed lighting fixture of claim 18, wherein the fixture further comprises a driver unit, and wherein the LED array is disposed on one side of the circular flat plate top, a second low profile heat sink is disposed on the opposite side of the circular flat plate top, and the driver unit is disposed against the second low profile heat sink.

20. The recessed lighting fixture of claim 19, wherein the fixture further comprises a socket adapter wired to the driver unit.

* * * * *